US012669024B1

(12) United States Patent
Abdo et al.

(10) Patent No.: US 12,669,024 B1
(45) Date of Patent: Jun. 30, 2026

(54) SYSTEMS AND METHODS FOR DETERMINING RADIAL DRILLING FLUID INVASION

(71) Applicant: HALLIBURTON ENERGY SERVICES, INC., Houston, TX (US)

(72) Inventors: Mohamad Abdo, Austin, TX (US); Bin Dai, Katy, TX (US); Wael Elhawary, Katy, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/240,177

(22) Filed: Jun. 17, 2025

(51) Int. Cl.
*E21B 49/00* (2006.01)
*E21B 21/08* (2006.01)
*E21B 44/00* (2006.01)

(52) U.S. Cl.
CPC ..... *E21B 21/08* (2013.01); *E21B 49/005* (2013.01); *E21B 44/00* (2013.01)

(58) Field of Classification Search
CPC ..... E21B 21/08
See application file for complete search history.

(56) References Cited

U.S. PATENT DOCUMENTS

2003/0217845 A1* 11/2003 Sherwood ..... E21B 49/10 166/264
2008/0156486 A1* 7/2008 Ciglenec ..... E21B 49/10 700/282
2015/0039275 A1* 2/2015 Mikhailov ..... E21B 37/00 703/2
2015/0369957 A1* 12/2015 Cig ..... E21B 49/08 702/12

* cited by examiner

*Primary Examiner* — David Carroll
(74) *Attorney, Agent, or Firm* — Polsinelli PC

(57) ABSTRACT

Provided herein is a system for determining a radius of invasion of a drilling fluid. The system can include a formation tester tool and at least one processor. The formation tester tool can be operable to be positioned in a wellbore. The formation tester tool can be operable to measure at least one property of a formation fluid within the wellbore. The at least one pump can be operable to pump a drilling fluid into the wellbore. The at least one processor can be configured to receive the at least one property of the fluid within the wellbore, a drilling pressure, a formation pressure, and at least one property of the drilling fluid, receive a drilling schedule including at least one change in an downhole environmental condition, and determine a radius of invasion of the drilling fluid based on the at least one property of the fluid, the drilling pressure, the formation pressure, the at least one property of the drilling fluid, and the drilling schedule.

20 Claims, 16 Drawing Sheets

SYSTEMS AND METHODS FOR DETERMINING RADIAL DRILLING FLUID INVASION

FIELD

The present disclosure relates generally to systems and methods for determining a radius of invasion of drilling fluid into formation fluids.

BACKGROUND

Wellbores are typically drilled at selected locations into subsurface formations into to obtain fluids from the formations. A drilling fluid, which can also be referred to as mud, is used during drilling of the wellbores. Mud serves a number of purposes, such as cooling the drill bit, carrying cuttings to the surface, providing pressure to maintain wellbore stability, and sealing off the wellbore, amongst other functions. During and after drilling, the mud filtrate mixes with the fluid contained in the formation (formation fluid) and invades into the formation fluid. For safety purposes, a majority of wellbores are drilled under over-burdened or overpressure conditions (e.g., the pressure gradient of the mud column is greater than the natural pressure gradient of the formation in which the wellbore is drilled). Due to the overpressure condition, mud penetrates into the formation surrounding the wellbore at varying depths, thereby contaminating the natural fluid contained in the formation.

BRIEF DESCRIPTION OF THE DRAWINGS

Implementations of the present technology will now be described, by way of example only, with reference to the attached figures, wherein.

DETAILED DESCRIPTION

Figure 1:
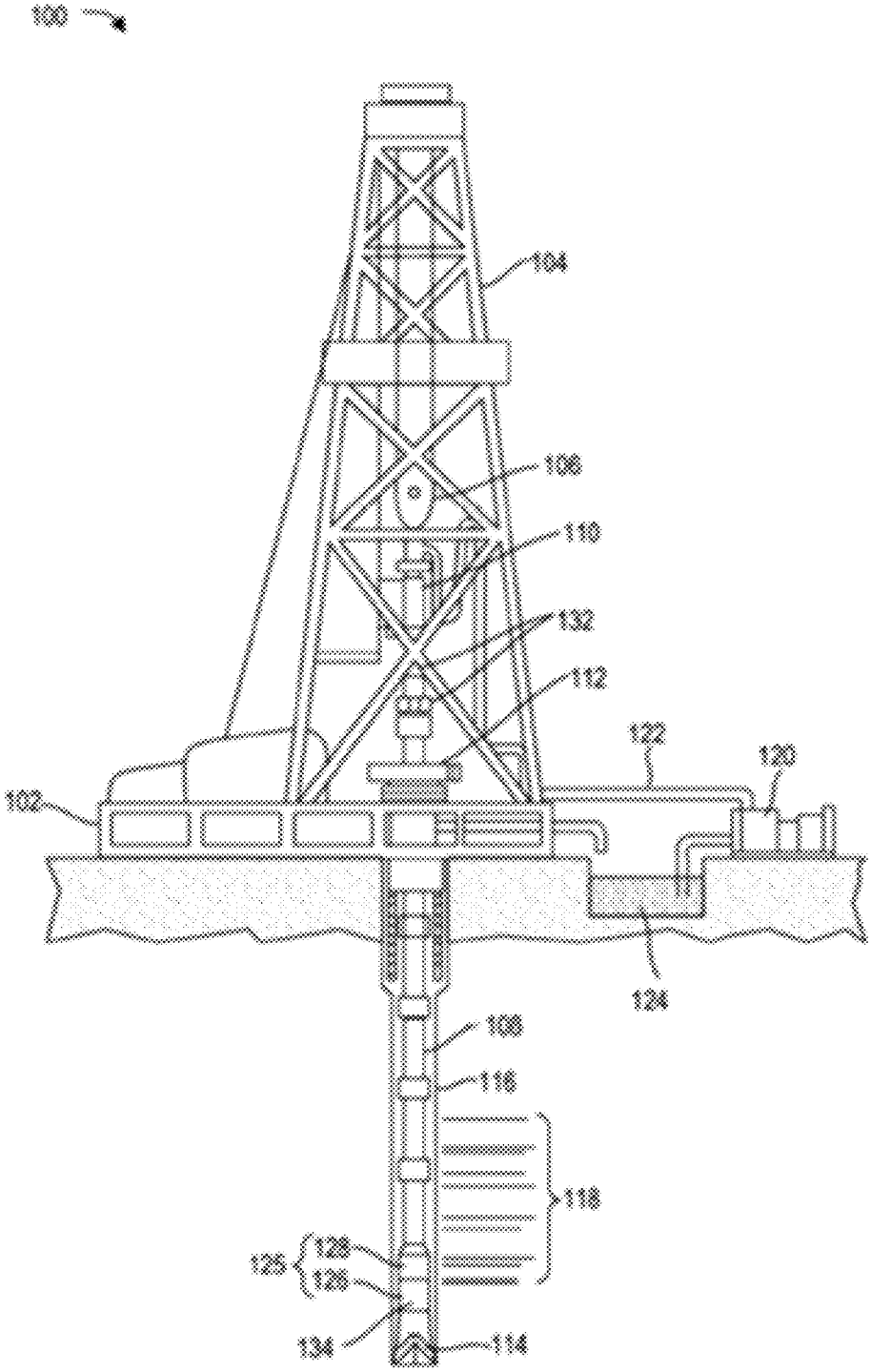
FIG. 1 is a schematic diagram of an example logging while drilling (LWD) wellbore operating environment in accordance with various aspects of the disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

In oil and gas drilling operations, drilling fluid is typically used during the drilling process to lubricate the drill bit, carrying drill debris to the surface, providing pressure to maintain wellbore stability, cooling the drill bit, and sealing the wellbore. However, as drilling fluid is used in the wellbore, the drilling fluid can mix with (e.g., invade into) formation fluids (e.g., oil and gas). The formation fluids are the target of the drilling operation. For example, the drilling fluids are the fluids to be pumped out of the wellbore and later used for various purposes. Drilling fluids are commonly referred to as drilling mud. Mud-filtrate is the liquid component of the mud (e.g., drilling fluid) that filters through formations and into formation fluids. For the purposes of this disclosure, drilling fluid invasion and mud-filtrate invasion are used interchangeably.

The mixing of the drilling fluid with formation fluids is known as drilling fluid invasion (e.g., mud-filtrate invasion). In order to pump out the formation fluids, the drilling fluid must be removed. To remove the drilling fluid, an amount of drilling fluid invasion must be determined to determine the volume of fluid to pump out of the wellbore before pumping the formation fluid. If the drilling fluid invasion is not known, too much fluid may be removed from the wellbore, thereby wasting formation fluid. Alternatively, too little drilling fluid may be removed, thereby contaminating the formation fluid pumping process.

Previous methods for determining the invasion of drilling fluid into the formation fluid have been inaccurate, thereby causing inefficiencies in retrieving the formation fluid. Provided herein are systems and methods that overcome the deficiencies of previous drilling fluid invasion determinations. The systems and methods described herein are operable to accurately determine a radius of invasion of the drilling fluid, thereby providing an accurate drilling fluid removal volume before pumping of formation fluid. Previous methods for determining the radius of invasion of the drilling fluid overlooked several key factors. For example, previous methods assume that the radius of invasion is solely dependent on the properties of the drilling fluid and the properties of the formation fluid. Previous methods did not account for changes in downhole environmental conditions during drilling (e.g., switches between static and dynamic drilling, pauses in drilling, and removal of mud cakes). Further, previous methods did not account for capillary diffusion growing during invasion due to the nature of filtration and the geometric factor of the formation. The systems and methods described herein overcome the deficiencies of prior methods by accounting for changes in environment conditions and the growth of capillary diffusion.

FIG. 1 illustrates a system 100 for drilling a wellbore. The system 100 can be operable to determine a radius of invasion of a drilling fluid into a formation.

In some examples, a drilling arrangement is shown that exemplifies a LWD configuration in a wellbore drilling scenario. The LWD typically incorporates sensors that acquire formation data. The drilling arrangement of FIG. 1 also exemplifies measurement while drilling (MWD) and utilizes sensors to acquire data from which the wellbore's path and position in three-dimensional space may be determined.

FIG. 1 shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 may be connected to the lower end of the drill string 108. As the drill bit 114 rotates, the drill bit 114 creates a wellbore 116 that passes through one or more subterranean formations 118. A pump 120 circulates drilling fluid through a supply pipe 122 to top drive 110, down through the interior of the drill string 108, and out orifices in the drill bit 114 into the wellbore. The drilling fluid returns to the surface via the annulus around the drill string 108, and into a retention pit 124. The drilling fluid transports cuttings from the wellbore 116 into the retention pit 124 and the drilling fluid's presence in the annulus aids in maintaining the integrity of the wellbore 116. Various materials may be used for drilling fluid, including oil-based fluids and water-based fluids.

In some examples, a collar 134 is a frequent component of a drill string 108 and generally resembles a very thick-walled cylindrical pipe, typically with threaded ends and a hollow core for the conveyance of drilling fluid. In some cases, multiple collars 134 may be included in the drill string 108 and are constructed and intended to be heavy to apply weight on the drill bit 114 to assist the drilling process. Because of the thickness of the collar's wall, pocket-type cutouts or other type recesses may be provided into the collar's wall without negatively impacting the integrity (strength, rigidity, and the like) of the collar 134 as a component of the drill string 108.

In some examples, one or more logging tools 126 may be integrated into the bottom-hole assembly 125 near the drill bit 114. As the drill bit 114 extends the wellbore 116 through the subterranean formations 118, logging tools 126 collect measurements relating to various formation properties as well as the orientation of the tool and various other drilling conditions. In some cases, the logging tools interface with various sensors and equipment. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled by one or more wires and/or another communication arrangement. The logging tools 126 may also include one or more computing devices communicatively coupled with one or more of the tool components. The one or more computing devices may be configured to control or monitor the performance of the tool, process logging data, and/or carry out one or more aspects of the methods and processes of the present disclosure.

In some examples, one or more of the logging tools 126 may communicate with a surface receiver 132 by a wire, such as a wired drill pipe. In other cases, the one or more of the logging tools 126 may communicate with a surface receiver 132 by wireless signal transmission, such as ground penetrating radar. In at least some cases, one or more of the logging tools 126 may receive electrical power from a wire that extends to the surface, including wires extending through a wired drill pipe.

Figure 2:
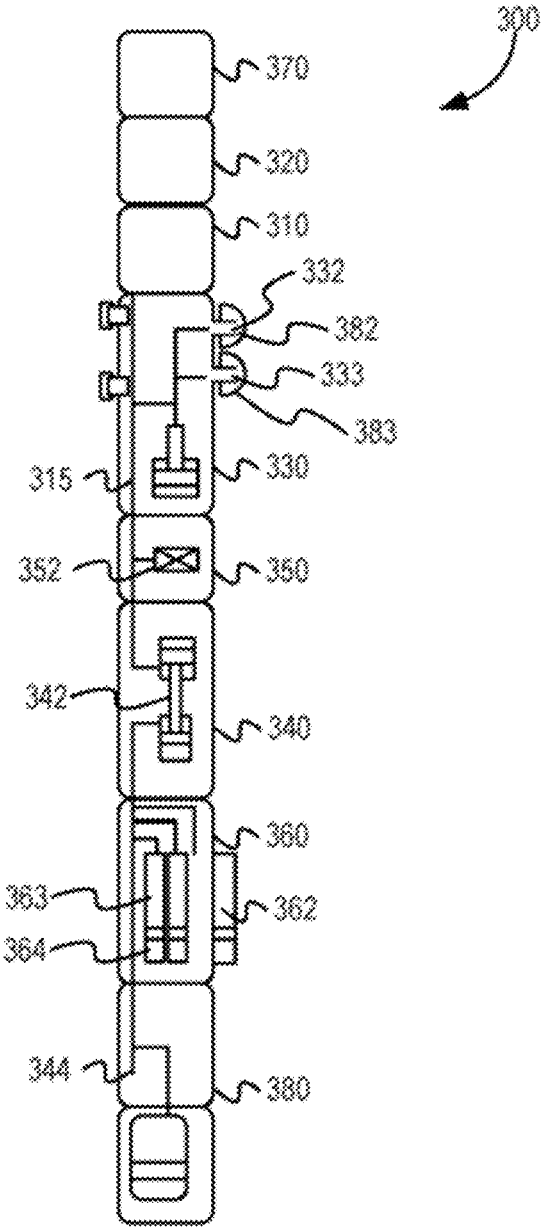
FIG. 2 illustrates an example of a formation tester tool.

In some examples, the logging tools 126 can include a formation tester tool 300, as illustrated, for example, in FIG. 2. The formation tester tool 300 can be operable to record measurements of the formation fluid within the wellbore 116.

The formation tester tool 300 may include an injection device 310, a power module 320, a probe module 330, a flow control module 340 regulating the flow of various fluids in and out of the tool, a fluid test module 350, a sample collection module 360, and a power telemetry module 370. Various modules can be rearranged depending on the specific applications. The probe module 330 can be operable to take samples of the formation fluids. The flow control module 340 can be operable to regulate the flow of various fluids in and out of the too. The fluid test module 350 can be operable to perform tests on a fluid sample. The sample collection module 360 can include chambers for storage of collected samples. The power telemetry module 370 can provide electrical and data communication modules, an up hole computing device, and other modules 380.

The power telemetry module 370 can condition power for the remaining tool sections. Each section can have its own process-control system and can function independently. While the power telemetry module 370 provides a common intra-tool power bus, the entire tool string (extensions beyond formation tester tool 300 not shown) can share a common communication bus that is compatible with other logging tools. Such an arrangement would enable the formation tester tool 300 to be combined with other logging systems, including, but not limited to, a Magnetic Resonance Image Logging (MRIL) or High-Resolution Array Induction (HRAI) logging systems.

In some examples, the injection device 310 and/or probe module 330 can inject fluids into the formation before collecting samples/measurements or inject fluids into the formation as samples are being collected. The flow control module 340 of the formation tester tool 300 can include a piston pump 342, which can control the formation fluid flow from the earth formation drawn into probes 332, 333 of the probe module 330. While the formation tester tool 300 is shown to have two probes, alternative formation tester tools can have a different number of probes, such as only one probe or three or more probes. Formation fluid which is drawn in via probes 332 and 333 can be taken into a flow line 315 for mobility testing within fluid test module 350 and/or provided to sample collection module 360. The extracted fluid can be referred to herein as a fluid sample whether used for fluid mobility testing or collection in sample collection module 360. The piston pump 342 can draw fluid from the formation via the probes 332, 333. The pump operation can be monitored by the computing device described herein. A fluid control device, such as a control valve, can be connected to flow line 315 to control the flow of fluid from the flow line 315. Flow control module 340 may additionally include one or more flow rate sensors and/or pressure sensors such as strain-gauge pressure transducers that can acquire measurements such as flow rate and/or inlet and outlet pump pressures.

In order to test the mobility of the fluid drawn from the formation, the fluid test module 350 of the formation tester tool 300 can include a fluid testing device having fluid sensors, which can analyze the fluid flowing through flow line 315. Any suitable device or devices can be utilized to analyze the fluid mobility of the formation using fluid sensors. These devices for determining fluid mobility can include, but are not limited to, pressure sensors such as quartz pressure crystal pressure transducers/gauges. Additionally, devices may be employed which include a number of different types of sensors. For example, in such gauge carriers the pressure resonator, temperature compensation, and reference crystal are packaged as a single assembly with each adjacent crystal in direct contact. The assembly can be contained in an oil bath that is hydraulically coupled with the pressure being measured. The quartz gauge enables the device to obtain sensor measurements such as the drawdown pressure of fluid being withdrawn from the earth formation and the fluid temperature. In at least one instance, two fluid testing sensor devices 352 can be run in tandem to obtain a pressure difference between fluid testing sensor devices 352 and determine the viscosity of the fluid while pumping is in process or the density of the fluid once flow is stopped. Flow rate sensors can also be employed to determine the flow rate of the fluid being extracted to determine mobility/viscosity of hydrocarbon in the formation. In addition, either the fluid test module 350 or another module of the formation tester tool 300 can include additional sensors such as optical sensors, resistivity sensors, etc., wherein some or all of the sensors of the formation tester tool 300 can be employed in parallel.

Sample collection module 360 of the formation tester tool 300 can contain chambers of various sizes for storage of the collected fluid sample. The sample collection module 360 can include at least one collection tube 362 and can additionally include a piston that divides collection tube 362 into an upper chamber 363 and a bottom chamber 364. A conduit can be coupled with bottom chamber 364 to provide fluid communication between bottom chamber 364 and the outside environment, such as the inner surface of the wellbore. Additionally, a fluid flow control device, such as an electrically controlled valve, can be placed in the conduit to selectively open and close the valve to allow fluid communication between the bottom chamber 364 and the wellbore. Similarly, sample collection module 360 may also contain a fluid flow control device, such as an electrically operated control valve, which is selectively opened and closed to direct the formation fluid from the flow line 315 into the upper chamber 363.

Probe module 330, including probes 332 and 333, can have electrical and mechanical components that can facilitate testing, sampling, and extraction of fluids from the earth formation. The probes 332 and 333 can be laterally extendable by one or more actuators inside the probe module 330 to extend the probes 332 and 333 away from the formation tester tool 300. Probe module 330 can retrieve and sample formation fluids throughout an earth formation along the longitudinal axis of the wellbore. The probes 332 and 333 can be coupled with the sealing pads 382 and 383 to provide a sealing contact with the inside surface of the wellbore at a desired location. At least one of the probes 332 and 333 can additionally include one or more strain sensors such as a high-resolution temperature compensated strain gauge pressure transducer (not shown), that can be isolated with shut-in valves to monitor probe pressure. Fluids from the sealed-off part of the earth formation may be collected through one or more slits, fluid flow channels, openings, outlets or recesses in the sealing pad. The recesses in the sealing pad can be elongated along the axis of the pad. While a probe module 330 with a single probe is illustrated, it would be understood by those in the art that any number of probes may be used without diverging from the scope of this description.

During a drilling operation, the formation fluid can be tested by the formation tester tool 300. For example, the formation tester tool 300 can be operable to determine various properties of the formation fluid. In some examples, the formation tester tool 300 can be operable to determine a type of fluid within the wellbore (e.g., water, oil, gas, multi-phase fluids water and oil mixtures, multi-phase gas and water mixtures, multi-phase gas and oil fixtures, etc.). The type of formation fluid can provide information regarding the fluid such as viscosity, density, compressibility, conductivity, pH values, fluid compositions, fluid gas to oil ratios, and other properties used in the methods for determining the radius of invasion of the drilling fluid described herein.

The system 100 can include at least one processor. In some examples, the at least one processor can be a component of the computing system described herein. In some examples, the at least one processor can be operable to perform various functions to determine the radius of invasion of the drilling fluid into the formation. For example, the at least one processor can be configured to receive the at least one property of the formation fluid within the wellbore. In some examples, the at least one processor can further be configured to receive a drilling schedule. In some examples, the drilling schedule can be received via a user input, an automated input, a semi-automated input, a generative artificial intelligence input, a distributed input (e.g., an input from other drilling equipment), input from elsewhere on the tool, or any other input operable to provide a drilling schedule. In some examples, the at least one processor can be configured to receive other parameters within the wellbore and/or formation during the drilling operation. For example, the at least one processor can be operable to receive at least one property of the drilling fluid, a drilling pressure, and a formation pressure, as described further herein.

In some examples, the drilling schedule can significantly impact the determination of the radius of invasion of the drilling fluid into the formation. For example, the drilling schedule can cause at least one change in the downhole environmental conditions within the wellbore. In some examples, an operator may decide to change various parameters of the drilling operation, which causes changes to the downhole environmental conditions in the wellbore. In some examples, the drilling schedule can be a pre-planned drilling schedule. When the drilling schedule is a pre-planned drilling schedule, a final radius of invasion of the drilling fluid can be calculated prior to beginning the drilling process. In this manner, the drilling process can be adjusted if the radius of invasion for a pre-planned drilling operation is outside of a threshold radius of invasion. In other examples, the drilling schedule can be a schedule of a completed drilling operation. For example, the various operations conducted during an operation can be recorded and then input into the computing device to determine the radius of invasion.

In some examples, an operator can change from static drilling to dynamic drilling. During static drilling, the drilling fluid (e.g., mud column) is static, meaning that there is no circulation in the drilling fluid. During dynamic drilling, the drilling fluid is circulated, which increases pressure on the wellbore wall, and thereby the formation fluid, due to the circulation pressure. Changing from one type of drilling to another can cause significant changes in the radius of invasion of the drilling fluid, as increased pressure causes increased invasion into the formation fluid, as will be mathematically described further herein.

In some examples, the at least one change in the downhole environmental condition can further include removal of a least a portion of the drilling fluid. In some examples, as the wellbore is drilled, mud cake build up occurs on the walls of the wellbore. The mud cake may be removed at a certain time within the drilling process in a well conditioning step. However, removal of the mud cake also causes removal of some of the drilling fluid, which can effect the radius of invasion of the drilling fluid, as described further mathematically herein. Further, removal of the mud cake can allow unimpeded invasion of the drilling fluid (e.g., mud-filtrate) into the formation. The removal of the mud cake can be included in the drilling schedule.

In some examples, the at least one change in the downhole environmental condition can further include a pause in drilling. In some examples, drilling operations can pause at certain periods of time within the drilling schedule. The radius of invasion of the drilling fluid can depend on time of the pause in drilling, as described further mathematically herein.

In some examples, the at least one processor can be operable to determine the radius of invasion of the drilling fluid based on the at least one property of the formation fluid and the drilling schedule. In some examples, the at least one processor can perform different calculations dependent on flow of the drilling fluid and the formation fluid, as described further herein. For example, based on the type of drilling fluid used and the type of formation fluid tested by the formation tester tool 300, the type of flow can be determined. In some examples, the flow can be miscible flow or immiscible flow. In some examples, the flow is miscible flow when the formation fluid and the drilling fluid are of the same type (e.g., the formation fluid is oil and the drilling fluid is oil). In some examples, the flow is immiscible flow when the formation fluid and the drilling fluid are of different types (e.g., the formation fluid is oil and the drilling fluid is water).

In some examples, after the radius of invasion of the drilling fluid is determined, the at least one processor can be configured to determine a drilling fluid removal volume based on the radius of invasion. In some examples, the pump 120 can be configured to remove the drilling fluid removal volume. The drilling fluid removal volume can be based on the radius of invasion of the drilling fluid into the formation fluid. For example, the drilling fluid removal volume can be the volume of fluid that needs to be removed such that the formation fluid is sitting against the wellbore 116. Once the drilling fluid removal volume is removed from the wellbore, the formation fluid can be extracted from the wellbore 116.

Figure 3:
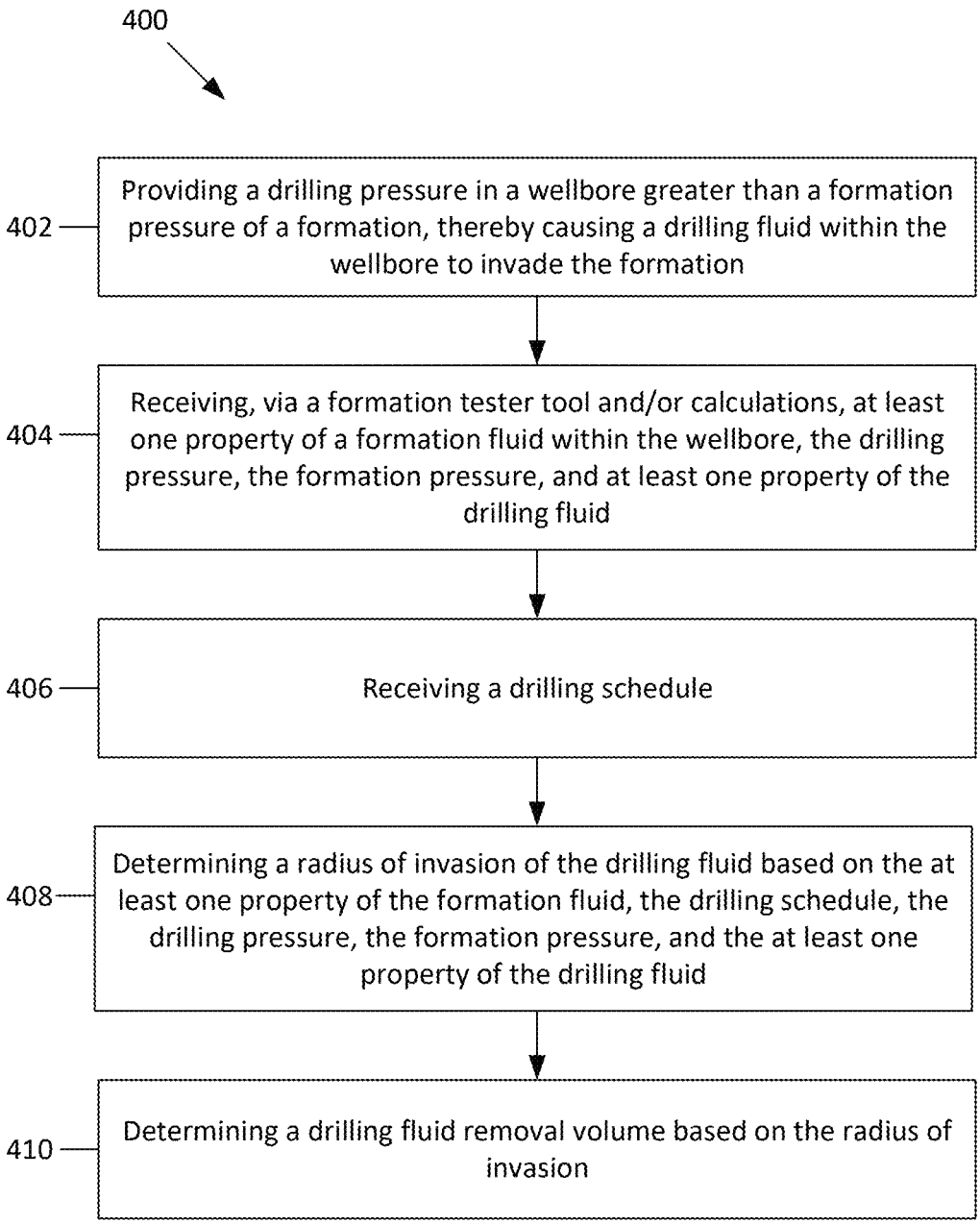
FIG. 3 illustrates a flowchart for a method of determining an invasion radius of mud-filtrate.

Further provided herein is a method for determining a radius of invasion of a drilling fluid into a formation fluid of a wellbore. FIG. 3 illustrates the method 400. In some examples, the method 400 can be performed using any of the systems, tools, or components described herein.

At block 402, the method 400 can begin by providing a drilling pressure in a wellbore greater than a formation pressure of a formation, thereby causing a drilling fluid to invade the formation. In some examples, the drilling pressure being greater than the formation pressure can be referred to as an overbalance drilling operation.

In some examples, prior to providing the drilling pressure, the method 400 can include pumping, via at least one pump, a drilling fluid into a wellbore. The drilling fluid can be pumped into the wellbore in any of the manners described herein. Once the drilling fluid has been pumped into the wellbore, the overbalance drilling operation can proceed.

At block 404, the method 400 can include receiving, via a formation tester tool and/or calculations, at least one property of a formation fluid within the wellbore, the drilling pressure, the formation pressure, and at least one property of the drilling fluid. In some examples, the formation tester tool can be operable to determine a type of fluid for the formation fluid. In some examples, the type of fluid can allow for the determination of various properties of the formation fluid, such as viscosity compressibility, conductivity, pH values, fluid compositions, fluid gas to oil ratios, and other properties. In some examples, calculations can be conducted to determine the drilling pressure and formation pressure. For example, the formation tester tool can be operable to provide data necessary to calculate the drilling pressure and the formation pressure. In some examples, the drilling pressure can be determined via a pressure sensor in the formation tester tool or a pressure sensor in another downhole tool. In some examples, the at least one property of the drilling fluid can include known properties of the drilling fluid. For example, the at least one property of the drilling fluid can include a type of fluid, viscosity, compressibility, conductivity, pH values, fluid compositions, fluid gas to oil ratios, and other properties.

At block 406, the method 400 can include receiving a drilling schedule. In some examples, the drilling schedule can be received via a user input, an automated input, a semi-automated input, a generative artificial intelligence input, a distributed input (e.g., from other equipment), input from elsewhere on the tool, or any other kind of input operable to provide the drilling schedule. In some examples, the drilling schedule can include at least one change to a downhole environmental condition within the wellbore. In some examples, the drilling schedule can be a pre-planned drilling schedule. When the drilling schedule is a pre-planned drilling schedule, a final radius of invasion of the drilling fluid can be calculated prior to beginning the drilling process. In this manner, the drilling process can be adjusted if the radius of invasion for a pre-planned drilling operation is outside of a threshold radius of invasion. In other examples, the drilling schedule can be a schedule of a completed drilling operation. For example, the various operations conducted during an operation can be recorded and then input into the computing device to determine the radius of invasion.

In some examples, the drilling schedule can significantly impact the determination of the radius of invasion of the drilling fluid into the formation. For example, the drilling schedule can cause at least one change in the downhole environmental conditions within the wellbore. In some examples, an operator may decide to change various parameters of the drilling operation, which causes changes to the downhole environmental conditions in the wellbore. For example, an operator can change from static drilling to dynamic drilling. During static drilling, the drilling fluid (e.g., mud column) is static, meaning that there is no circulation in the drilling fluid. During dynamic drilling, the drilling fluid is circulated, which increases pressure on the wellbore wall, and thereby the formation fluid, due to the circulation pressure. Changing from one type of drilling to another can cause significant changes in the radius of invasion of the drilling fluid, as increased pressure causes increased invasion into the formation fluid, as will be mathematically described further herein.

In some examples, the at least one change in the downhole environmental condition can further include removal of a least a portion of the drilling fluid. In some examples, as the wellbore is drilled, mud cake build up occurs on the walls of the wellbore. The mud cake may be removed at a certain time within the drilling process in a well conditioning step. However, removal of the mud cake also causes removal of a portion of the drilling fluid, which can affect the radius of invasion of the drilling fluid, as described further mathematically herein. Further, removal of the mud cake can also increase the rate of invasion of the drilling fluid into the formation fluid, as described further mathematically herein. For example, the mud cake can generally block some of the drilling fluid from invading further into the formation fluid. When the mud cake is removed, the drilling fluid invasion into the formation fluid is unimpeded. The removal of the mud cake can be included in the drilling schedule.

In some examples, the at least one change in the downhole environmental condition can further include a pause in drilling. In some examples, drilling operations can pause at certain periods of time within the drilling schedule. The radius of invasion of the drilling fluid can depend on time of the pause in drilling, as described further mathematically herein.

At block 408, the method 400 can include determining a radius of invasion of the drilling fluid based on the at least one property of the formation fluid, the drilling schedule, the drilling pressure, the formation pressure, and the at least one property of the drilling fluid. Determining the radius of invasion of the drilling fluid can include a series of mathematical calculations (e.g., a model), as described herein.

The model for determining the radius of invasion begins with a non-linear 3 cylindrical radial layers darcy solution. The solution is non-linear because it depends on function $f(d)$, which is a function of damages produced by the volume of drilling fluid injected flowing through the reservoir (e.g., wellbore). To obtain the damages function, a fractional flow solution for immiscible flow and a Fick's law solution for miscible flow are needed. The following equations (1)-(4) summarize previous invasion mass balance derivations:

$$\frac{dx_{mc}(t)}{dt} = \frac{v_0(1-\phi)C_s \ln\frac{r_e}{r_w}}{\rho_{mc}(1-\phi_{mc})(r_w - x_{mc}(t))\left(\int_{r_w}^{r_e}\frac{1}{rf(d)}dr - \frac{k_0}{k_{mc}}\ln\left(1-\frac{x_{mc}(t)}{r_w}\right)\right)} \tag{1}$$

$$v_0 = \frac{k_0 \Delta p}{\mu_f \ln\left(\frac{r_e}{r_w}\right)} \tag{2}$$

$$f(d) = \begin{cases} 1 - \frac{C}{C_f} & \text{if miscible} \\ k_r\left(1 - \frac{S_w - S_{wirr}}{1 - S_{wirr} - S_{or}}\right) & \text{if immiscible} \end{cases} \tag{3}$$

$$v(t, r_w) = \frac{v_0 \ln\frac{r_e}{r_w}}{\int_{r_w}^{r_e}\frac{1}{rf(d)}dr - \frac{k_0}{k_C}\ln\left(1-\frac{x_{mc}(t)}{r_w}\right)} \tag{4}$$

Where $v$ is the velocity of the drilling fluid, k is the relative permeability, $r_e$ is the radius of the reservoir outer boundary, $r_w$ is the wellbore radius, $\mu_f$ is the filtrate viscosity, c is the compressibility, $\Delta p$ is the pressure drop, $x_{mc}$ is the mud cake thickness, $\Phi$ is the formation porosity, $k_{mc}$ is the permeability of the mud cake, $\Phi_{mc}$ is the porosity of the mud cake, $\rho_{mc}$ is the density of the mud cake, $k_o$ is the oil permeability, $s_w$ is the water saturation, $s_{wirr}$ is the irreducible water saturation, and t is time.

Figure 4:
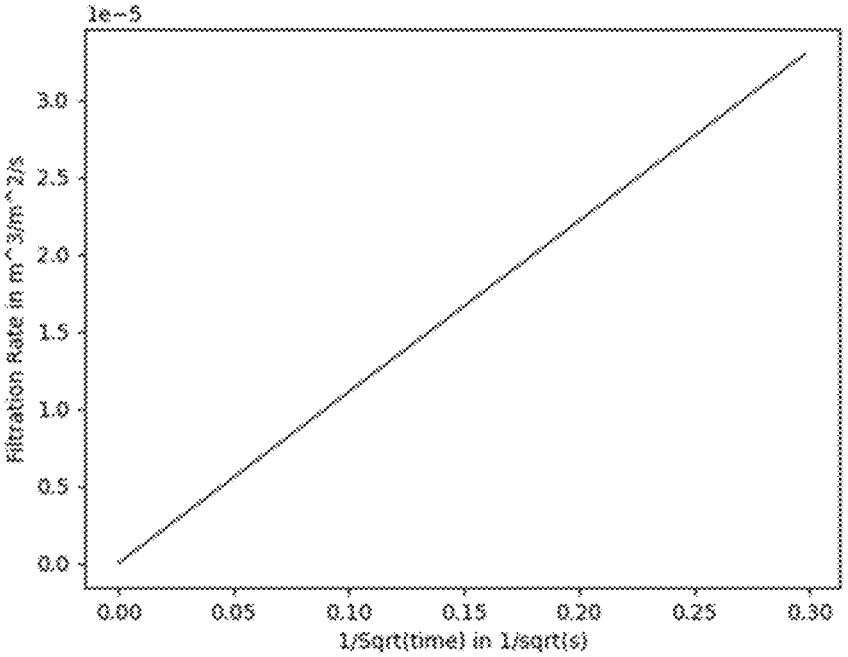
FIG. 4 illustrates a graph of an invasion rate using a continuous, steady, and uninterrupted drilling fluid buildup.

The filtration equations are solved using a Runge-Kutta algorithm to solve ordinary equations. The resultant invasion rate is a function linear with the inverse square root of time and has a y-axis intersect at zero, as illustrated in FIG. 4. As illustrated in FIG. 4, the invasion rate is ascending with the inverse of time, which means, mathematically, it is descending with time. It is assumed that the invasion rate (e.g., the velocity of invasion), can be mathematically illustrated by equation (5):

$$v(t, r_w) = \frac{\alpha}{\sqrt{t}} \tag{5}$$

Equation (5), however, is not the final form of the invasion equation. Equation (5) is only applicable when there are no environmental changes (e.g., changes in pressure due to switching between static and dynamic drilling or well condition where the mud cake is removed mid-buildup). Equation (5) provides a calculation for a continuous, steady, and uninterrupted buildup.

For equations (1)-(5) to account for formation damages, a 1D radial reservoir simulator is needed to obtain $f(d)$. Consequently, the model performs multiple iterations by finding a through the invasion system of equations, then performs a reservoir flow simulation to obtain $f(d)$, and then updates $\alpha$ until $\alpha$ becomes consistent.

When drilling a section of the well, drillers can decide to switch between having a static mud column and circulating the mud. Consequently, the pressure applied on the mud cake wall will increase due to the circulation pressure. The mud cake is compressible and the effect on mud cake properties, and therefore invasion of the drilling fluid, are mathematically translated into equation (5) through equations (6) and (7).

$$\phi_{mc} = \frac{\phi_{mc}^0}{p_{mc}^{\delta v}} \tag{6}$$

$$K_{mc} = \frac{K_{mc}^0}{p_{mc}^{\gamma}} \tag{7}$$

Where $K_{mc}$ is the permeability of the mud cake, $\phi_{mc}$ is the porosity of the mud cake, and $p_{mc}$ is the density of the mud cake.

Multiple models exist to describe the compressibility of the mud cake including ones that account for hysteresis. The model described herein can allow a user to define a compressibility model that defines mud cake permeability and porosity.

Another example of changes to the downhole environmental conditions is mud cake removal. Mud cake removal is mathematically defined as a time offset in the denominator of equation (5). Since the mud (e.g., drilling fluid) has the same properties before and after mud cake removal, the numerator of equation (5) depends on the pressure in the wellbore and the denominator depends on the time at which the mud cake is removed. Consequently, the changes to the downhole environmental conditions can be represented in equations (8)-(10).

$$v(t, r_w) = \frac{\alpha(t)}{\sqrt{t - t_0(t)}} \tag{8}$$

$$\alpha(t) = \alpha_m \text{ during } t_m \le t < t_{m+1} \tag{9}$$

$$t_0(t) = t_n \text{ during } t_n \le t < t_{n+1}, \tag{10}$$

For equation (9), m is the index of the switch between static and dynamic. For equation (9), n is the index of the mud cake removal.

Figure 5:
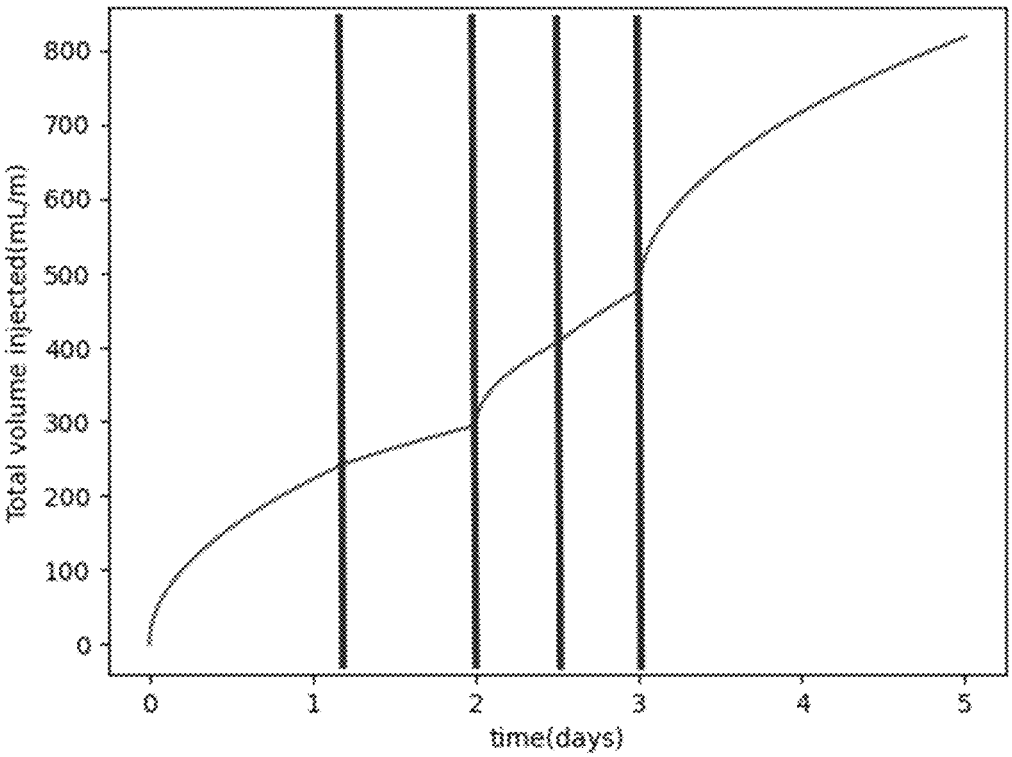
FIG. 5 illustrates a total produced volume of mud-filtrate in a wellbore with the following drilling schedule: at time zero (the moment where that depth was reached by the driller) $K_{mc}(0)=0.54$ μD, at time 1.2 days $K_{mc}(1.2$ days$)=0.27$ μD, at time 2 days mud cake removal, at time 2.5 days $K_{mc}(2.5$ days$)=0.76$ μD, at time 3 days mud cake removal.

FIG. 5 illustrates the effects of the environmental changes in accordance with a drilling schedule on the total mass balance. Time zero is the moment where the final drilling depth is reached by the drill, $K_{mc}$(0 days)=0.54 μD. At 1.2 days the mud cake was removed, $K_{mc}$(1.2 days)=0.27 μD. At 2.5 days $K_{mc}$(2.5 days)=0.76 μD. Mud cake removal occurred at 2 days and 3 days.

One of the objectives during formation testing is to pump sufficient fluid to obtain a representative sample in the formation testing chamber (e.g., as provided by the formation tester tool). In the case of miscible invasion, the drilling fluid and the formation fluids do not compete in the pore space. The derivation of a 1D convection-diffusion equation in radial coordinated can be seen in equations (11)-(13):

$$\frac{\partial c}{\partial t} = -\nabla \cdot J + R, \text{ assuming } R = 0, \frac{\partial c}{\partial t} = -\nabla \cdot J \tag{11}$$

For convection+diffusion, $J=-D\nabla c+vc$ $$\frac{\partial c}{\partial t} = \nabla \cdot (D\nabla c - vc) \tag{13}$$

Equation (14) illustrates the space is radial (e.g., the wellbore is radial):

$$\frac{\partial c}{\partial t} = \frac{1}{r}\frac{\partial}{\partial r}\left(rD\frac{\partial c}{\partial r}\right) - \frac{1}{r}\frac{\partial}{\partial r}(rvc) \tag{14}$$

Equation (15) expands equation (11):

$$\frac{\partial c(t, r)}{\partial t} = D(t, r)\frac{\partial^2 c(t, r)}{\partial r^2} + \left(\frac{\partial D(t, r)}{\partial r^2} + \frac{D(t, r)}{r} - v(t, r)\right)\frac{\partial c(t, r)}{\partial r} - \frac{v(t, r)c(t, r)}{r} - c(t, r)\frac{\partial v(t, r)}{\partial r} \tag{15}$$

The velocity term v (e.g., the invasion rate of the drilling fluid) is obtained by applying a radial geometric factor to equation (8), as shown in equation (16):

$$v(t, r) = \frac{\alpha(t)}{\sqrt{t - t_0(c)}}\frac{r_w}{t} \tag{16}$$

The diffusion coefficient is obtained using Poulin's relationship, as shown in equation (17). The unit of the diffusion coefficient D (r,t) is $cm^2/s$.

$$D(t, r) = 51.7 * 10^{-4} * (v(r, t))^{1.25} \tag{17}$$

The boundary conditions for equation (15) are shown in equations (18)-(20):

$$c(t, r_w) = c_m, 0 < t < \infty \tag{18}$$

$$\frac{\partial c(t, r_e)}{\partial r} = 0, 0 < t < \infty \tag{19}$$

$$c(0, r) = 0, r_w < r \le r_e \tag{20}$$

Equation (15) is not homogenous, therefore a simple numeral simulator was developed to obtain the concentration of contaminates (e.g., drilling fluid) with space and time. Time-stepping-wise, the simulator used Forward Euler. Space-wise, the simulator uses an upwind scheme. Additionally, the space is gridded logarithmically. The radial length of the grid after $r=r_w$ is defined then a growth rate is defined so the grid expands as the radius increases to $r_e$. Equation (15) therefore becomes equation (21):

$$\frac{c_r^t - c_r^{t-1}}{\Delta t} = D_{r-1}^{t-1}\frac{\partial^2 c_{r-1}^{t-1}}{\partial r^2} + \left(\frac{\partial D_{r-1}^{t-1}}{\partial r} + \frac{D_{r-1}^{t-1}}{r_{r-1}} - v_{r-1}^{t-1}\right)\frac{\partial c_{r-1}^{t-1}}{\partial r} - \frac{v_{r-1}^{t-1}c_{r-1}^{t-1}}{r_{r-1}} - C_{r-1}^{t-1}\frac{\partial v_{r-1}^{t-1}}{\partial r} \tag{21}$$

For the first order space derivatives, forward finite difference is used. For the second order space derivative, central finite difference is used, as shown in equations (22) and (23):

$$\frac{\partial c_{r-1}^{t-1}}{\partial r} = \frac{c_r^{t-1} - c_{r-1}^{t-1}}{r_r - r_{r-1}} \tag{22}$$

$$\frac{\partial^2 c_{r-1}^{t-1}}{\partial r^2} = \frac{\frac{c_r^{t-1} - c_{r-1}^{t-1}}{r_r - r_{r-1}} - \frac{c_{r+1}^{t-1} - c_r^{t-1}}{r_{r+1} - r_r}}{\frac{r_{r+1} - r_{r-1}}{2}} \tag{23}$$

The invasion level is given by equation (24):

$$fc(r, t) = \frac{c(r, t)}{c_m} \tag{24}$$

Figure 6A:
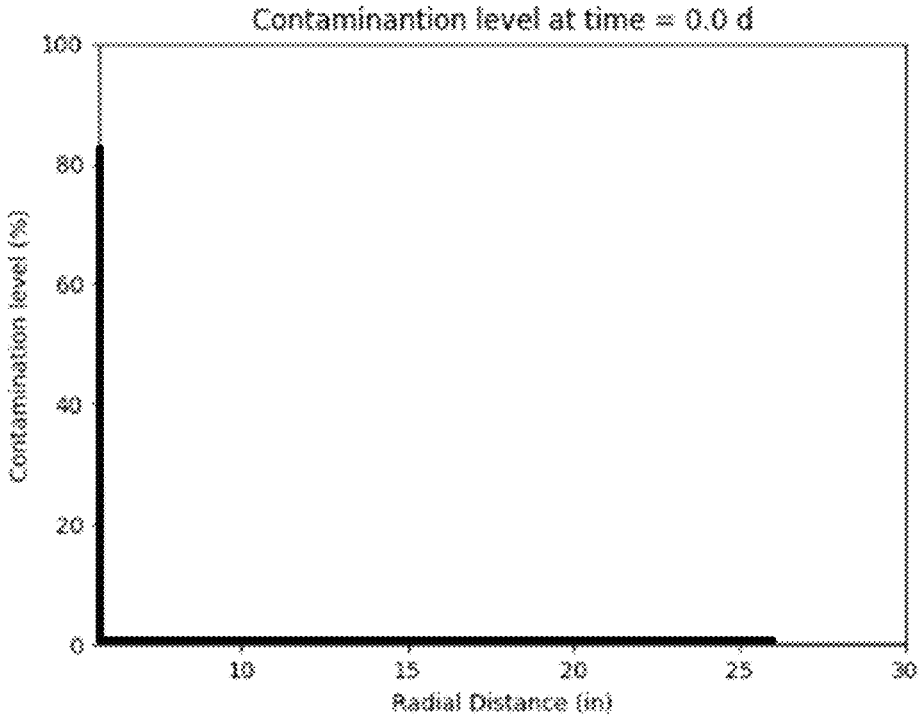
FIG. 6A illustrates a contamination level (%) and radial distance of invasion of drilling fluid at 0 days.
Figure 6B:
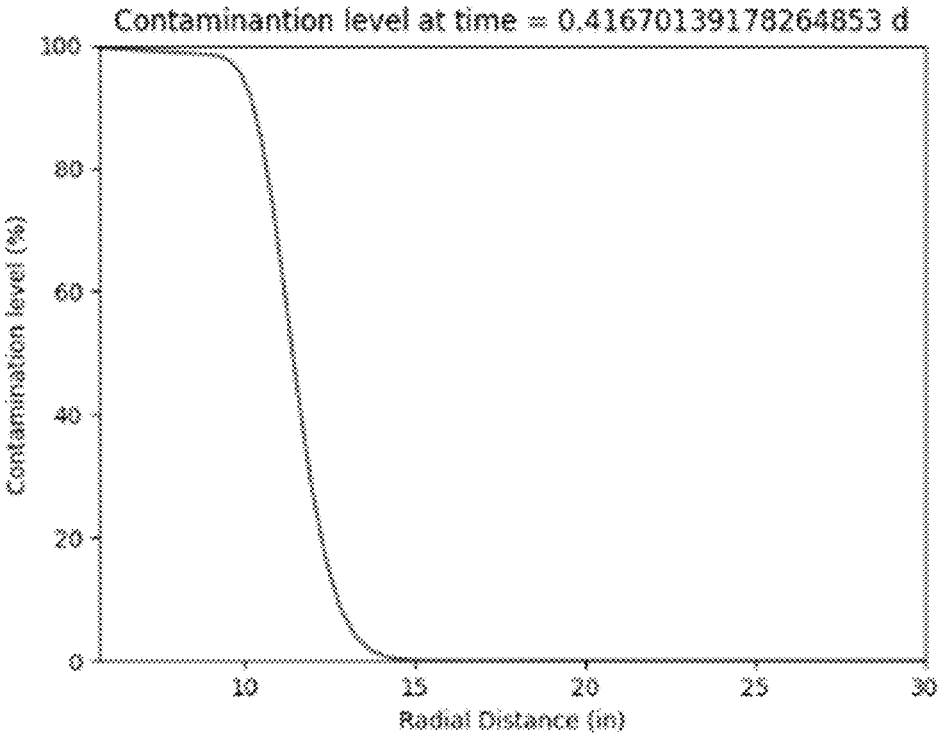
FIG. 6B illustrates a contamination level (%) and radial distance of invasion of drilling fluid at 0.41 days.
Figure 6C:
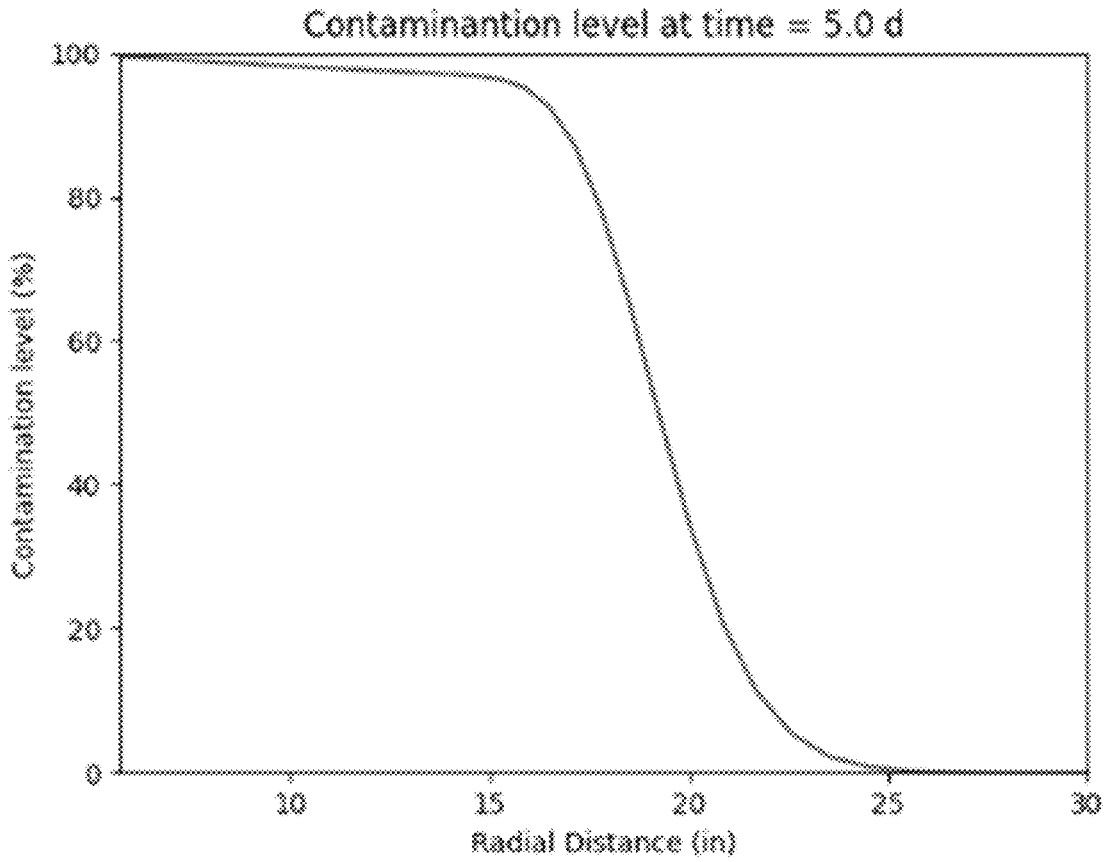
FIG. 6C illustrates a contamination level (%) and radial distance of invasion of drilling fluid at 5 days.

The evolution of the solution with time and space is illustrated in FIGS. 6A-6C. FIGS. 6A-6C illustrate the evolution of contamination (e.g., invasion) through 5 days over 30 inches, where the x-axis starts at 6 inches.

The formation damage from equation (3) can be written as equation (25):

$$f(d) = 1 - f_c(r, t) \tag{25}$$

Solving for the radial invasion of the drilling fluid when the flow is immiscible is different from miscible flow. The difference between miscible and immiscible invasion is the interaction between the drilling fluid (e.g., mud-filtrate) and the formation fluid. Specifically, the permeability of the formation is hindered for each phase. The factor by which the formation permeability reduces is called relative permeability and is phase specific. In addition, in immiscible flow, the filtrate (e.g., drilling fluid) becomes its own phase. In other words, the contamination level becomes the phase saturation, as shown in equation (26).

$$fc(r, t) = S_{filtrate} = S_i - S_n \tag{26}$$

S is the saturation.

To derive the base equation, the mass balance for any phase is stated. Equation (27) is further simplified to equation (28) by assuming incompressibility of phases and pore space, no source terms, and that r>>Δr:

$$m_\alpha|_{t+\Delta t} - m_\alpha|_t = \rho_\alpha v_\alpha|_{r+\Delta r} a_{r+\Delta r} \Delta t - \rho_\alpha v_\alpha|_r a_r \Delta t \tag{27}$$

$$V = h * \pi\left((r + \Delta r)^2 - r^2\right); a(r) = 2\pi rh \tag{27-1}$$

$$\frac{V((\rho_\alpha S_\alpha \phi)|_{t+\Delta t} - (\rho_\alpha S_\alpha \phi)|_t}{\Delta t} = 2\pi(r + \Delta r)h\rho u_\alpha|_{r+\Delta r} - 2\pi rh\rho u_\alpha|_r \tag{27-2}$$

$$\left(2r\Delta r + \Delta r^2\right)\frac{(S_\alpha \phi)|_{t+\Delta t} - (S_\alpha \phi)|_t}{\Delta t} = 2((r + \Delta r)u_\alpha|_{r+\Delta r} - ru_\alpha|_r) \tag{27-3}$$

$$\frac{\left(2r\Delta r + \Delta r^2\right)}{\Delta r}\frac{(S_\alpha \phi)|_{t+\Delta t} - (S_\alpha \phi)|_t}{\Delta t} = 2\frac{((r + \Delta r)u_\alpha|_{r+\Delta r} - ru_\alpha|_r)}{\Delta r} \tag{27-4}$$

$$(2r + \Delta r)\frac{(S_\alpha \phi)|_{t+\Delta t} - (S_\alpha \phi)|_t}{\Delta t} = 2\frac{((r + \Delta r)u_\alpha|_{r+\Delta r} - ru_\alpha|_r)}{\Delta r} \tag{27-5}$$

$$2r\frac{(S_\alpha \phi)|_{t+\Delta t} - (S_\alpha \phi)|_t}{\Delta t} = 2\frac{((r + \Delta r)u_\alpha|_{r+\Delta r} - ru_\alpha|_r)}{\Delta r} \tag{27-6}$$

$$\phi\frac{\partial S_\alpha}{\partial t} = \frac{1}{r}\frac{\partial ru_\alpha}{\partial r} \tag{28}$$

Fluid dynamics in porous media are dictated by Darcy's law, shown in equations (29)-(30):

$$\phi\frac{\partial S_\alpha}{\partial t} + \frac{1}{r}\frac{\partial ru_\alpha}{\partial r} = 0; u_\alpha = -K\frac{k_{r\alpha}(S_\alpha)}{\mu_\alpha}\frac{\partial P_\alpha(S_\alpha)}{\partial r}; \tag{29}$$

$$P_c = P_n - P_i \tag{30}$$

$P_c$ is the capillary pressure.

To simplify the Darcy relationships in equation (29) the definition of mobility and further derivation are used to obtain equation (32):

$$\lambda_\alpha = \frac{k_{r\alpha}(S_i)}{\mu_\alpha} \tag{31}$$

$$f_i(r, t) = \frac{u_i(r, t)}{v(r, t)} = \frac{\lambda_i(S_i)}{\lambda_i(S_i) + \lambda_n(S_i)}\left(1 + \frac{K\lambda_n(S_i)}{v(r, t)}\frac{\partial P_c(S_i)}{\partial r}\right) \tag{32}$$

Equation (32) is known as the fractional flow theory. Typically, the invading phase (e.g., drilling fluid) is water, and the native phase (e.g., formation fluid) is oil. The right-hand side of equation (32) has two terms being added together. The first term, consisting only of the mobility ratio, is convective and is only dependent on viscous properties. The second term, consisting of both the mobility ratio, formation properties, and capillary pressure, is diffusive and dependent on the capillary pressure. The convective term has a solution that is entropic. It might have multiple solutions for one radial position at a given time. Therefore, the term is solved on its own at the beginning to get the viscous-dominated fractional flow by incorporating the mobility term with equation (28) and selecting the least entropic solution that satisfies mass balance.

The mass balance, equation (28), incorporated with the fractional flow term, equation (32), can be restated as equations (33)-(34):

$$\phi\frac{\partial S_i}{\partial t} + \frac{1}{r}\frac{\partial rv(t)f_i(S_i)}{\partial r} = \phi\frac{\partial S_i}{\partial t} + \frac{1}{r}\frac{\partial\left(r\frac{r_w\alpha(t)}{r\sqrt{t - t_0(t)}}f_i\right)}{\partial r} = 0 \tag{33}$$

$$\frac{\phi\sqrt{t - t_0(t)}}{\alpha(t)}\frac{\partial S_i}{\partial t} + \frac{r_w}{r}\frac{\partial f_i}{\partial S_i}\frac{\partial S_i}{\partial r} = 0 \tag{34}$$

Changes in saturation can be the sum of changes in space and changes in time. Therefore, the relationship between a given water saturation and radial distance can be derived using equations (35)-(36) to obtain equation (37):

$$dS_i = \partial t\frac{\partial S_i}{\partial t} + \partial r\frac{\partial S_i}{\partial r} = 0 \tag{35}$$

$$\partial t = \frac{\phi\sqrt{t - t_0(t)}}{\alpha(t)}; \partial r = \frac{r_w}{r}\frac{\partial f_i}{\partial S_i}; \tag{36}$$

$$\frac{\partial r}{\partial t} = \frac{r_w\alpha(t)}{r\sqrt{t - t_0(t)}}\frac{\partial f_i}{\partial S_i}; r(S_i, t) = \sqrt{\frac{2r_w}{\phi}\frac{\partial f_i(S_i)}{\partial S_i}\int_0^t \frac{\alpha(t)}{\sqrt{t - t_0(t)}}dt}; \tag{37}$$

Knowing the fractional flow for a set of values of the invading phase saturation and assuming $P_c$=0, the derivative can be obtained. Given any time during invasion and knowing the derivative of the fractional flow for a defined invading phase saturation, the radial position can be determined. Therefore, with equation (37) a set of radial coordinates can be obtained for a set of saturation points at any time. However, multiple phase saturations can exist at a given coordinate level. Physically, only one solution exists. The correct solution for each radius and timestep is the solution that satisfies the mass balance.

Next, the capillary portion of equation (32) is solved. The following equations (38)-(39) are used for simplification:

$$v_{mf}(t) = \frac{\alpha(t)}{\sqrt{t - t_0(t)}} \tag{38}$$

$$V(t) = \int_0^t \frac{\alpha(t)}{\sqrt{t - t_0(t)}} dt; \tag{39}$$

The problem is restated without simplification in equations (16), (32), (34) and (40):

$$f_{i,0}(S_i) = \frac{\lambda_i(S_i)}{\lambda_i(S_i) + \lambda_n(S_i)} \tag{40}$$

$$v(r, t) = \frac{r_w v_{mf}(t)}{r} \tag{16}$$

$$\phi \frac{\partial S_i}{\partial t} + v(r, t) \frac{\partial f_i}{\partial S_i} \frac{\partial S_i}{\partial r} = 0 \tag{34}$$

$$f_i(r, t) = f_{i,0}(S_i)\left(1 + \frac{K\lambda_n(S_i)}{v(r, t)} \frac{\partial P_c(S_i)}{\partial r}\right) \tag{32}$$

Similar to the above, the derivative of the fractional flow is obtained to solve equation (34) using equation (41):

$$\frac{\partial f_i(r, t)}{\partial S_i} = \frac{\partial f_{i,0}(S_i)}{\partial S_i} + \frac{\partial}{\partial S_i}\left(\frac{f_{i,0}(S_i) K\lambda_n(S_i)}{v(r, t)} \frac{\partial P_c(S_i)}{\partial S_i} \frac{\partial S_i}{\partial r}\right) \tag{41}$$

Equation (41) has the convective-diffusion form when integrated into equation (34). The convective coefficient and diffusion coefficient are shown in equations (42) and (43), respectively:

$$C(S_i) = \frac{\partial f_{i,0}(S_i)}{\partial S_i} \tag{42}$$

$$D(S_i) = f_{i,0}(S_i) K\lambda_n(S_i) \frac{\partial P_c(S_i)}{\partial S_i} \tag{43}$$

Equation (41) can be rewritten as:

$$\frac{\partial f_i(r, t)}{\partial S_i} = C(S_i) + \frac{\partial}{\partial S_i}\left(\frac{D(S_i)}{v(r, t)} \frac{\partial S_i}{\partial r}\right) \tag{41}$$

Integrating equation (41) into equation (34) produces equation (44):

$$\phi \frac{\partial S_i}{\partial t} + v(r, t) C(S_i) \frac{\partial S_i}{\partial r} + v(r, t) \frac{\partial}{\partial S_i}\left(\frac{D(S_i)}{v(r, t)} \frac{\partial S_i}{\partial r}\right) \frac{\partial S_i}{\partial r} = 0 \tag{44}$$

The following changes in variables were made in equations (45)-(45-4) resulting in equation (46).

$$\eta = \frac{r^2}{2r_w} + \frac{V(t)}{\phi} \tag{45}$$

$$\frac{\partial}{\partial t} = \frac{\partial}{\partial \eta} \frac{\partial \eta}{\partial t} = \frac{v_{mf}(t)}{\phi} \frac{\partial}{\partial \eta}; \frac{\partial}{\partial r} = \frac{\partial}{\partial \eta} \frac{\partial \eta}{\partial r} = \frac{r}{r_w} \frac{\partial}{\partial \eta}; \tag{45-1}$$

$$\phi \frac{v_{mf}(t)}{\phi} \frac{\partial S_i}{\partial \eta} + v(r, t) \frac{r}{r_w} C(S_i) \frac{\partial S_i}{\partial \eta} + v(r, t) \frac{r}{r_w} \frac{\partial}{\partial S_i}\left(\frac{D(S_i)}{v(r, t)} \frac{\partial S_i}{\partial r}\right) \frac{\partial S_i}{\partial \eta} = 0 \tag{45-2}$$

$$\phi \frac{1}{\phi} \frac{\partial S_i}{\partial \eta} + v(r, t) \frac{r}{v_{mf}(t) r_w} C(S_i) \frac{\partial S_i}{\partial \eta} + v(r, t) \frac{r}{v_{mf}(t) r_w} \frac{\partial}{\partial S_i}\left(\frac{D(S_i)}{v(r, t)} \frac{\partial S_i}{\partial r}\right) \frac{\partial S_i}{\partial \eta} = 0 \tag{45-3}$$

$$1 + C(S_i) + \frac{\partial}{\partial S_i}\left(\frac{D(S_i)}{v(r, t)} \frac{\partial S_i}{\partial r}\right) = 0 \tag{45-4}$$

$$\partial\left(\frac{D(S_i)}{v(r, t)} \frac{\partial S_i}{\partial r}\right) = -\partial S_i - C(S_i) \partial S_i \tag{46}$$

Equation (46) can be integrated between the maximum invading phase saturation (at the wellbore wall), and the invading phase saturation at any point of the reservoir. The left hand side of Equation (46) translates to integrating starting at 0, because the capillary diffusion at the borehole wall is always 0. Equations (47)-(49) illustrate the solution:

$$\frac{D(S_i)}{v(r, t)} \frac{\partial S_i}{\partial r} = -S_i + 1 - S_{n,res} - \int_{1-S_{n,res}}^{S_i} C(S_i) \partial S_i = 2 - S_{n,res} - S_i - f(S_i) \tag{47}$$

$$\frac{D(S_i)}{2 - S_{n,res} - S_i - f(S_i)} \partial S_i = v(r, t) \partial r = \frac{v_{mf} r_w}{r} \partial r \tag{48-1}$$

$$\int_{1-S_{n,res}}^{S_i} \frac{D(S_i)}{2 - S_{n,res} - S_i - f(S_i)} \partial S_i = v_{mf} r_w \ln\left|\frac{r}{r_w}\right|; \tag{48-2}$$

$$r_w \exp\left(\frac{1}{v_{mf}(t) r_w} \int_{1-S_{n,res}}^{S_i} \frac{D(S_i)}{2 - S_{n,res} - S_i - f(S_i)} \partial S_i\right) = r \tag{49}$$

Equation (49) describes the shape of the saturation front as a function of radius. While the equation is descriptive of the shape, it might fail to uphold the mass balance. Equation (49) accounts for the velocity profile but, unlike equation (37), does not include a term that is directly related to total volume injected. In equation (37), the mass balance has to be forced. A similar process can be applied, but the shape of the front can be preserved. In fact, the radius, function of the invading saturation, will be corrected by comparing the obtained total volume injected with the total volume produced by the mud cake, as shown in equations (50)-(53):

$$V_{mf}(t) = 2\pi r_w h \int_0^t \frac{\alpha(t)}{\sqrt{t - t_0(t)}} dt; \tag{50}$$

$$V_{inv}(t) = \int_{r_w}^{r(t)} 2\pi h \phi r (S_i(r, t) - S_i(r, 0)) dr; \tag{51}$$

$$f(t) = \frac{V_{mf}(t)}{V_{inv}(t)}; \tag{52}$$

$$r'(S_i, t) = \sqrt{(r(S_i, t)^2 - r_w^2) f(t) + r_w^2} \tag{53}$$

Figure 7A:
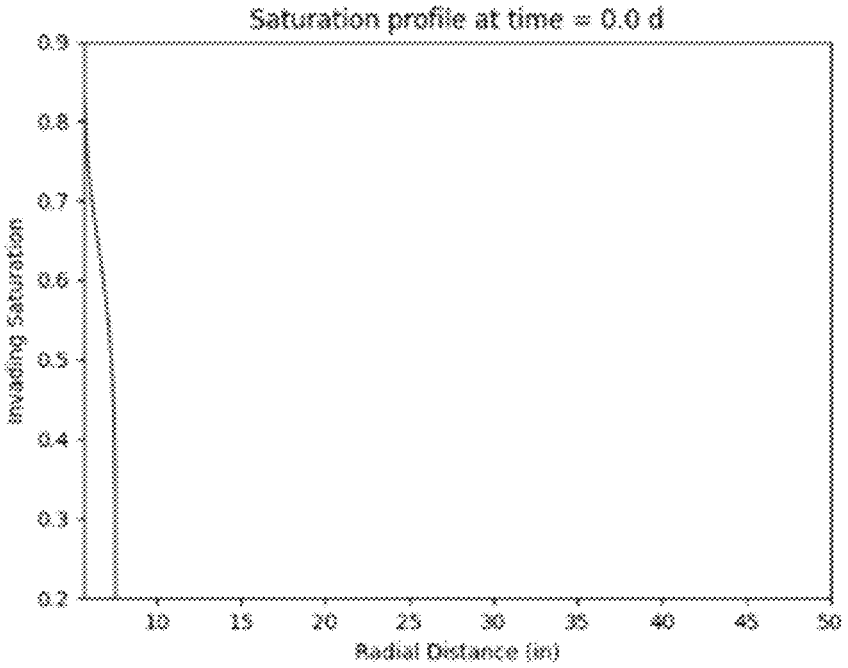
FIG. 7A illustrates a contamination level (%) and radial distance of invasion of the drilling fluid at 0 days.
Figure 7B:
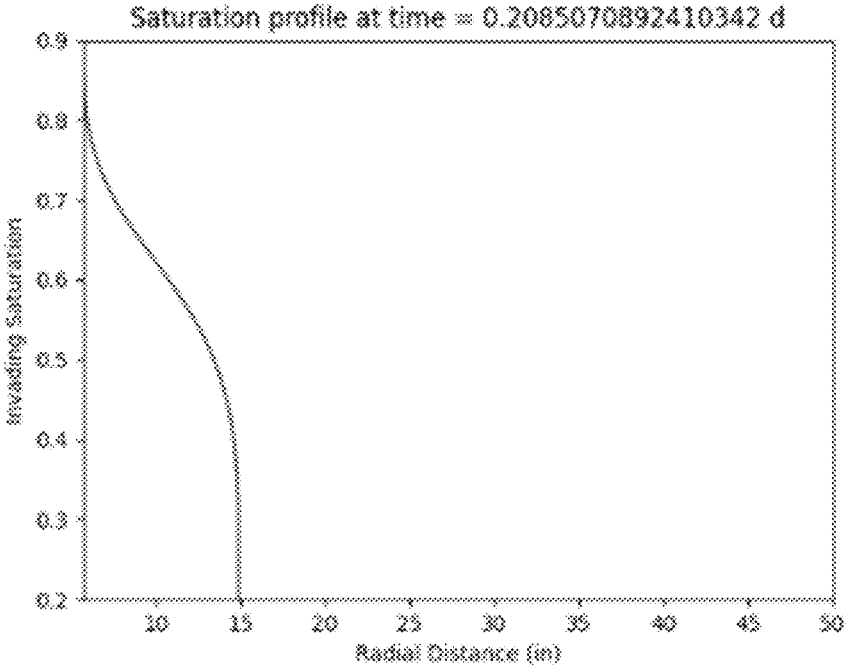
FIG. 7B illustrates a contamination level (%) and a radial distance of invasion of the drilling fluid at 0.208 days.
Figure 7C:
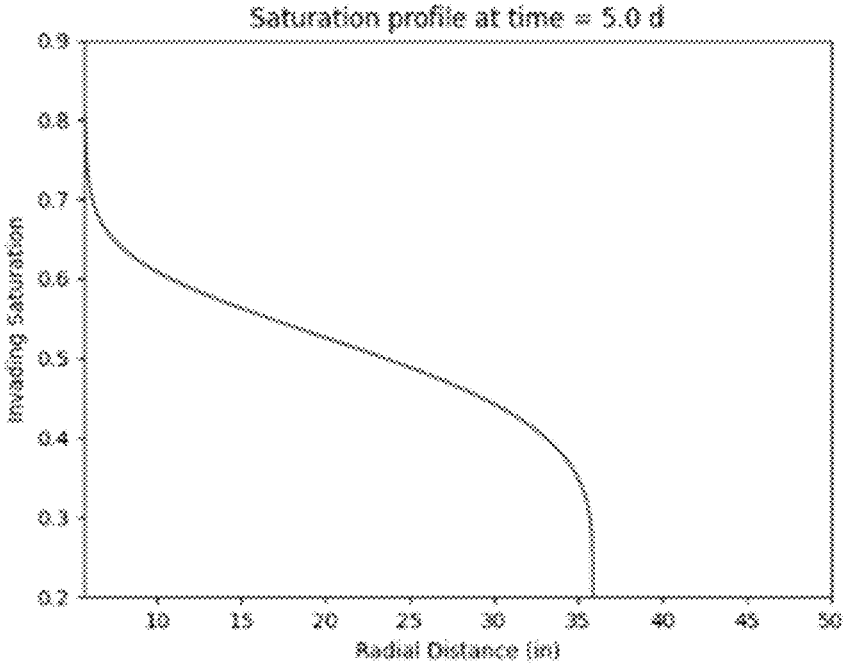
FIG. 7C illustrates a contamination level (%) and radial distance of invasion of the drilling fluid at 5 days.

FIGS. 7A-7C illustrate the evolution of contamination through 5 days over 30 inches, where the x-axis starts at 6 inches.

Equation (53) can be adjusted in some examples. In an example, where the velocity increases, the profiles of FIGS. 7A-7C become narrower and the saturation in the transition zone increases. In some examples, where the velocity of the filtrate (e.g., drilling fluid) at the borehole changes, it the front of invasion can flowback. However, this can be solved by comparing the profile at a given time step with the one before it. In this manner, a saturation shape part of the equation can be composed of the current time step's shape and the previous time step's shape.

Figure 8A:
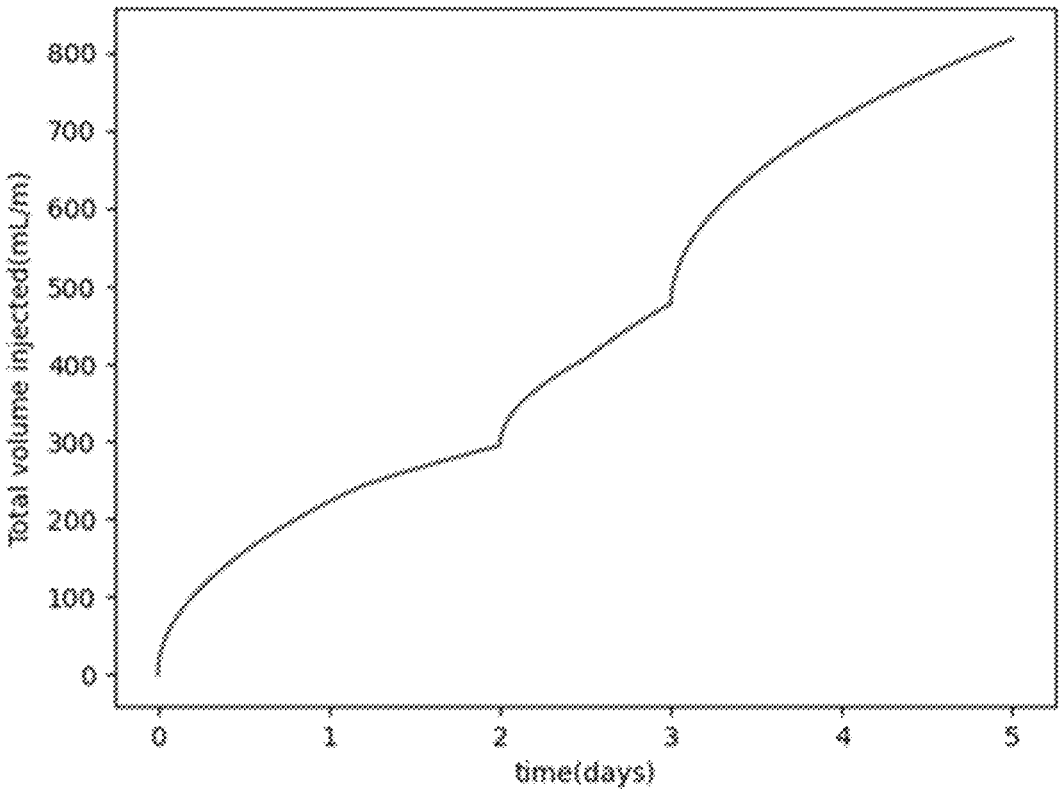
FIG. 8A illustrates an injection volume of drilling fluid over time in a drilling schedule.
Figure 8B:
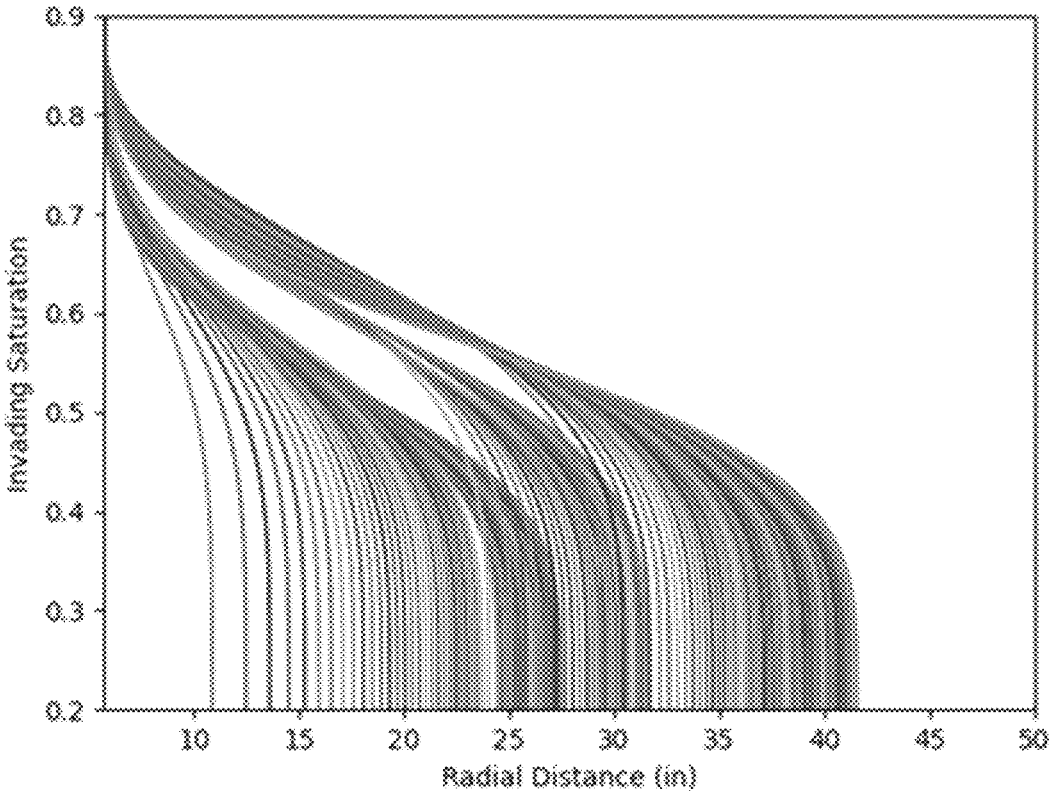
FIG. 8B illustrates invading saturation as a function of radial distance of invasion of the drilling fluid in an immiscible flow scenario adjusting for environmental changes.
Figure 8C:
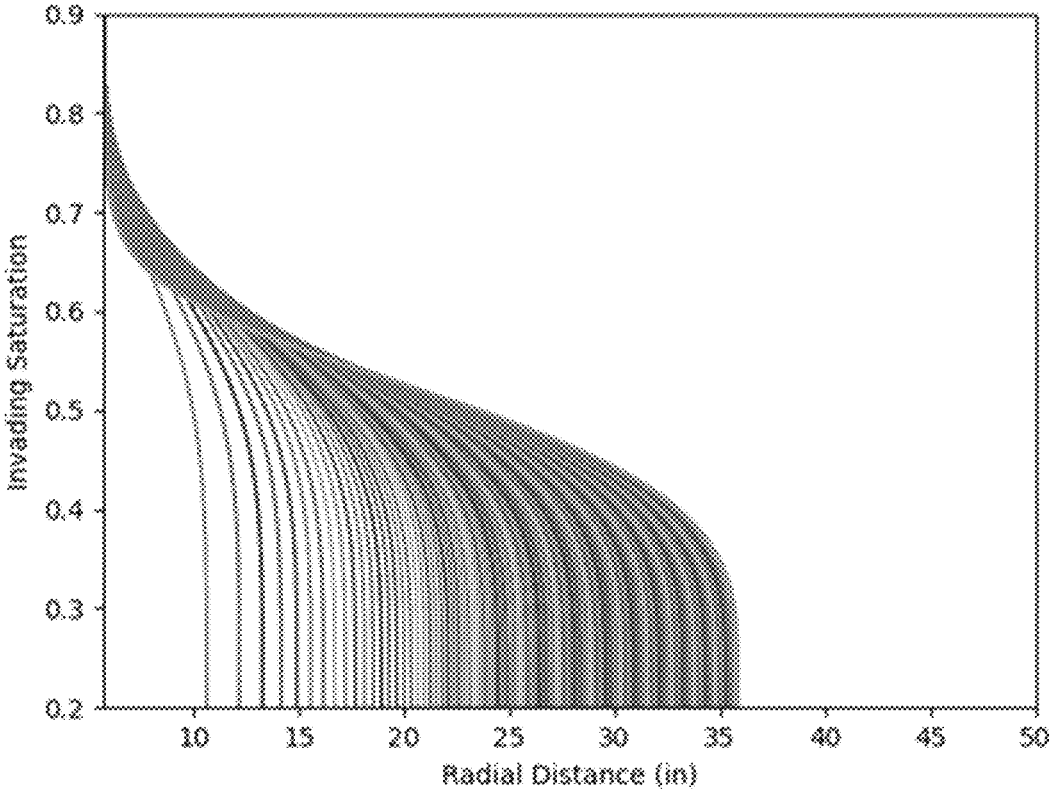
FIG. 8C illustrates invading saturation as a function of radial distance of invasion of the drilling fluid in an immiscible flow scenario without adjusting for environmental changes.

FIG. 8A illustrates a drilling fluid injection volume per time of a drilling schedule for an immiscible flow scenario. FIG. 8B illustrates the invading saturation and radius of invasion of the drilling fluid in an immiscible flow scenario while accounting for changes in downhole environmental conditions as described herein. For example, the drilling schedule includes mud cake removal at 2 days and at 3 days. FIG. 8C illustrates the invading saturation and radius of invasion of the drilling fluid in an immiscible flow scenario without accounting for the changes in downhole environmental conditions. As illustrated, accounting for the environmental changes provides a significantly different maximum radius of invasion (e.g., about 42 inches in FIG. 8B compared to about 36 inches in FIG. 8C). By accounting for the environmental changes, a more accurate calculation of the radius of invasion can be computed, thereby providing more accurate drilling operations after drilling fluid injection, as described further herein.

Figure 9A:
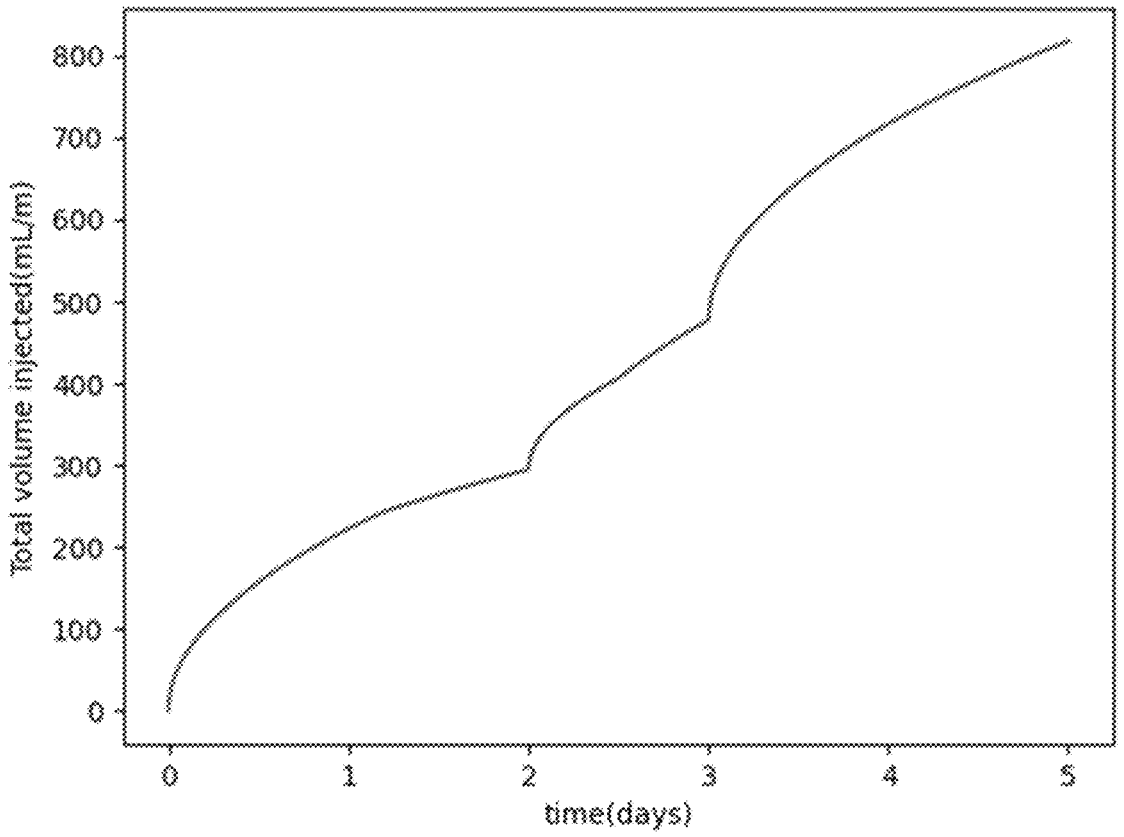
FIG. 9A illustrates an injection volume of drilling fluid over time in a drilling schedule.
Figure 9B:
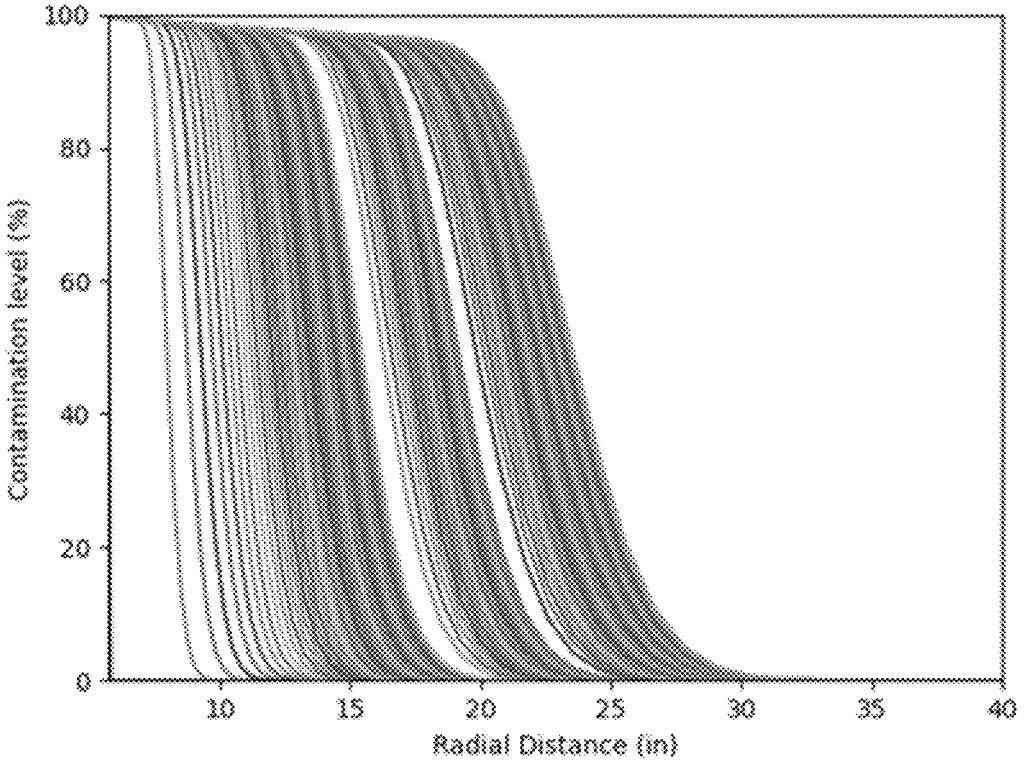
FIG. 9B illustrates invading saturation as a function of radial distance of invasion of the drilling fluid in a miscible flow scenario adjusting for environmental changes.
Figure 9C:
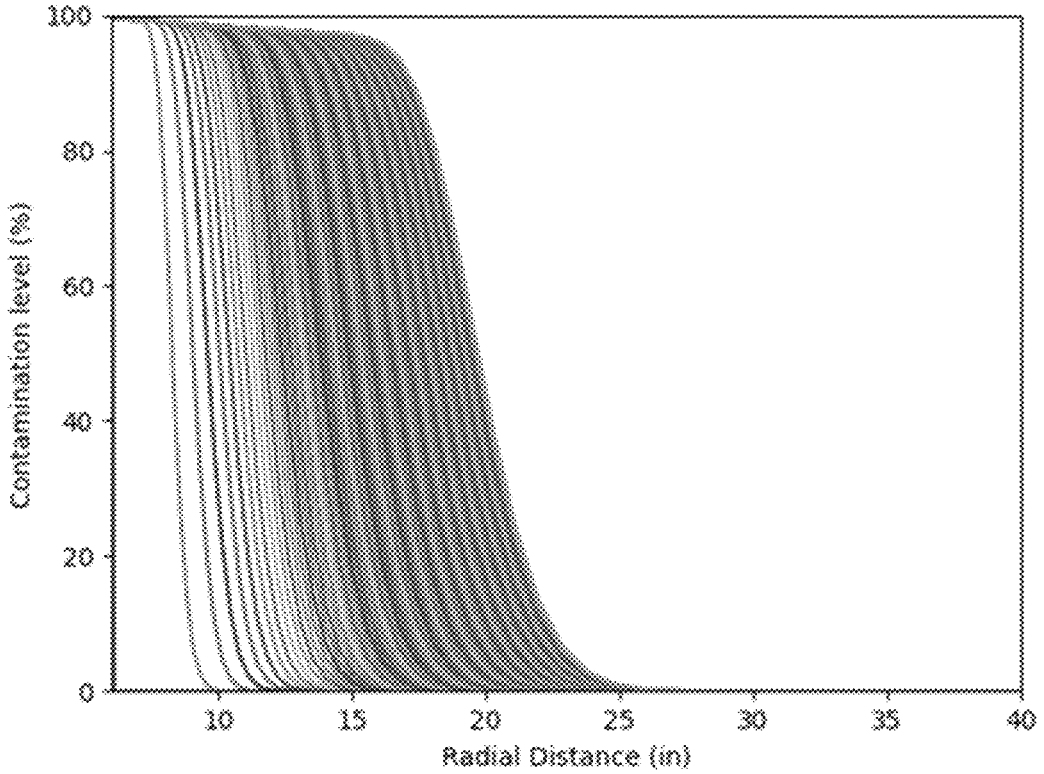
FIG. 9C illustrates invading saturation as a function of radial distance of invasion of the drilling fluid in a miscible flow scenario without adjusting for environmental changes.

FIG. 9A illustrates a drilling fluid injection volume per time of a drilling schedule for a miscible flow scenario. FIG. 9B illustrates the contamination level (%) and radius of invasion of the drilling fluid in a miscible flow scenario while accounting for changes in the downhole environmental conditions as described herein. For example, the drilling schedule includes mud cake removal at 2 days and at 3 days. FIG. 9C illustrates the contamination level (%) and radius of invasion of the drilling fluid in a miscible flow scenario without accounting for the changes in the downhole environmental conditions. As illustrated, accounting for the environmental changes provides a significantly different maximum radius of invasion (e.g., about 30 inches in FIG. 9B compared to about 25 inches in FIG. 9C). By accounting for the environmental changes, a more accurate calculation of the radius of invasion can be computed, thereby providing more accurate drilling operations after drilling fluid injection, as described further herein.

At block 410, the method 400 can include determining a drilling fluid removal volume based on the radius of invasion. For example, determining the radius of invasion can allow for a determination of the volume of drilling fluid that must be removed in order to collect the formation fluid from the wellbore. The drilling fluid removal volume can include a volume of the drilling fluid that must be removed to access the formation fluid. In some examples, the drilling fluid removal volume is the volume of fluid sufficient such that all fluid up to the maximum radius of invasion is removed from the wellbore. For example, the drilling fluid removal volume includes the volume of all fluid within the wellbore and the volume of fluid within the formation extending up to the maximum radius of invasion of the drilling fluid. In some examples, the removal volume can further be based on the drilling pressure and/or the formation pressure. For example, the removal volume can take into account the drilling pressure and/or formation pressure. In some examples, the removal volume can further account for permeability anisotropy.

In some examples, blocks 408 and 410 of the method 400 can be performed prior to beginning drilling operations. For example, based on the drilling schedule, a predicted radius of invasion, and therefore, a drilling fluid removal volume, can be determined. In this manner, an operator can adjust the drilling schedule as needed. For example, if the drilling fluid removal volume is too large, the schedule can be updated to reduce the radius of invasion (e.g., decreasing the time of dynamic drilling, decreasing drilling pauses, adjusting a number of mud cake removals, etc.). In some examples, the drilling fluid removal volume can be too large when there is not sufficient space to store the drilling fluid removed from the wellbore. In some examples, the drilling fluid removal volume is too large when removing the entire volume will take too long.

In some examples, the method 400 can further include removing the drilling fluid removal volume from the wellbore. For example, at least one pump can be used to pump the drilling fluid removal volume out of the wellbore. In some examples, the at least one pump can be the same pump as the pump that pumped the drilling fluid into the wellbore. In some examples, the at least one pump can be a different pump from the pump used to pump the drilling fluid into the wellbore.

In some examples, the method 400 can further be operable to determine a radius of invasion of fracturing fluids during production enhancement. For example, the method 400 can be used for determining the radius of invasion of fracturing fluids by replacing the drilling fluid parameters with fracturing fluid parameters and replacing the drilling operation parameters with fracture operation parameters. In this manner, the method 400 can be operable to provide a radius of invasion of fracturing fluids, thereby allowing for fracturing fluid removal volume determination and/or optimization of the fracturing process.

Figure 10:
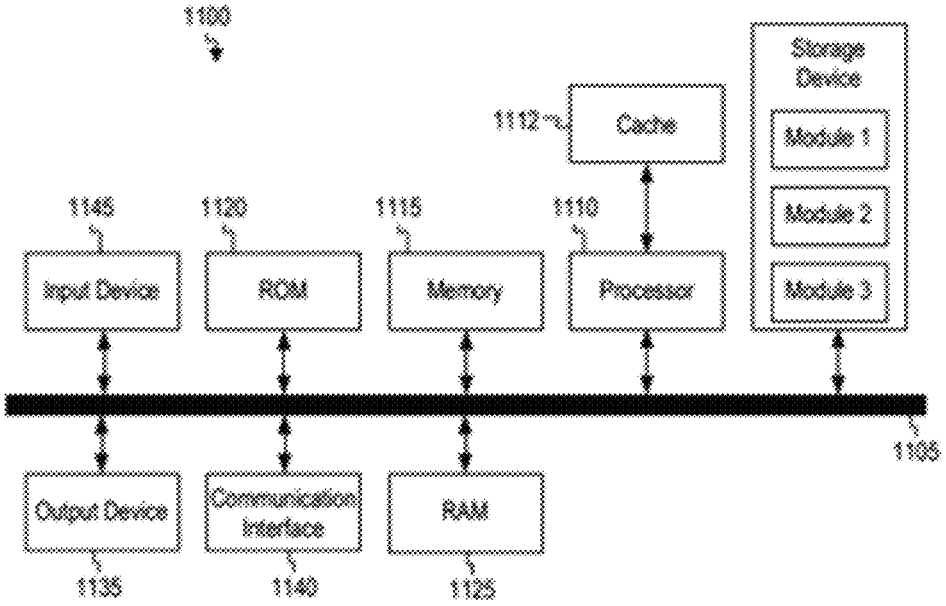
FIG. 10 is a diagram of a computing system.

FIG. 10 is a diagram illustrating an example of a system for implementing certain aspects of the present technology. In particular, FIG. 10 illustrates an example of computing system 1100, which can be for example any computing device making up internal computing system, a remote computing system, a camera, or any component thereof in which the components of the system are in communication with each other using connection 1105. Connection 1105 can be a physical connection using a bus, or a direct connection into processor 1110, such as in a chipset architecture. Connection 1105 can also be a virtual connection, networked connection, or logical connection.

In some aspects, computing system 1100 is a distributed system in which the functions described in this disclosure can be distributed within a datacenter, multiple data centers, a peer network, etc. In some aspects, one or more of the described system components represents many such components each performing some or all of the function for which the component is described. In some aspects, the components can be physical or virtual devices.

Example computing system 1100 includes at least one processing unit (CPU or processor) 1110 and connection 1105 that couples various system components including system memory 1115, such as read only memory (ROM) 1120 and read only memory (RAM) 1125 to processor 1110. Computing system 1100 can include a cache 1112 of high-speed memory connected directly with, in close proximity to, or integrated as part of processor 1110.

Processor 1110 can include any general purpose processor and a hardware service or software service, such as services 1132, 1134, and 1136 stored in storage device 1130, configured to control processor 1110 as well as a specialpurpose processor where software instructions are incorporated into the actual processor design. Processor 1110 may essentially be a completely self-contained computing system, containing multiple cores or processors, a bus, memory controller, cache, etc. A multi-core processor may be symmetric or asymmetric.

To enable user interaction, computing system 1100 includes an input device 1145, which can represent any number of input mechanisms, such as a microphone for speech, a touch-sensitive screen for gesture or graphical input, keyboard, mouse, motion input, speech, etc. Computing system 1100 can also include output device 1135, which can be one or more of a number of output mechanisms. In some instances, multimodal systems can enable a user to provide multiple types of input/output to communicate with computing system 1100. Computing system 1100 can include communications interface 1140, which can generally govern and manage the user input and system output. The communication interface may perform or facilitate receipt and/or transmission wired or wireless communications using wired and/or wireless transceivers, including those making use of an audio jack/plug, a microphone jack/plug, a universal serial bus (USB) port/plug, an Apple® Lightning® port/plug, an Ethernet port/plug, a fiber optic port/plug, a proprietary wired port/plug, a Bluetooth® wireless signal transfer, a BLE wireless signal transfer, an IBEACON® wireless signal transfer, an RFID wireless signal transfer, near-field communications (NFC) wireless signal transfer, dedicated short range communication (DSRC) wireless signal transfer, 802.11 WiFi wireless signal transfer, WLAN signal transfer, Visible Light Communication (VLC), Worldwide Interoperability for Microwave Access (WiMAX), IR communication wireless signal transfer, Public Switched Telephone Network (PSTN) signal transfer, Integrated Services Digital Network (ISDN) signal transfer, 3G/4G/5G/LTE cellular data network wireless signal transfer, ad-hoc network signal transfer, radio wave signal transfer, microwave signal transfer, infrared signal transfer, visible light signal transfer, ultraviolet light signal transfer, wireless signal transfer along the electromagnetic spectrum, or some combination thereof. The communications interface 1140 may also include one or more Global Navigation Satellite System (GNSS) receivers or transceivers that are used to determine a location of the computing system 1100 based on receipt of one or more signals from one or more satellites associated with one or more GNSS systems. GNSS systems include, but are not limited to, the US-based GPS, the Russia-based Global Navigation Satellite System (GLONASS), the China-based BeiDou Navigation Satellite System (BDS), and the Europe-based Galileo GNSS. There is no restriction on operating on any particular hardware arrangement, and therefore the basic features here may easily be substituted for improved hardware or firmware arrangements as they are developed.

Storage device 1130 can be a non-volatile and/or non-transitory and/or computer-readable memory device and can be a hard disk or other types of computer readable media which can store data that are accessible by a computer, such as magnetic cassettes, flash memory cards, solid state memory devices, digital versatile disks, cartridges, a floppy disk, a flexible disk, a hard disk, magnetic tape, a magnetic strip/stripe, any other magnetic storage medium, flash memory, memristor memory, any other solid-state memory, a compact disc read only memory (CD-ROM) optical disc, a rewritable compact disc (CD) optical disc, digital video disk (DVD) optical disc, a blu-ray disc (BDD) optical disc, a holographic optical disk, another optical medium, a secure digital (SD) card, a micro secure digital (microSD) card, a Memory Stick® card, a smartcard chip, a EMV chip, a subscriber identity module (SIM) card, a mini/micro/nano/pico SIM card, another integrated circuit (IC) chip/card, RAM, static RAM (SRAM), dynamic RAM (DRAM), ROM, programmable read-only memory (PROM), erasable programmable read-only memory (EPROM), electrically erasable programmable read-only memory (EEPROM), flash EPROM (FLASHEPROM), cache memory (L1/L2/L3/L4/L5/L#), resistive random-access memory (RRAM/ReRAM), phase change memory (PCM), spin transfer torque RAM (STT-RAM), another memory chip or cartridge, and/or a combination thereof.

The storage device 1130 can include software services, servers, services, etc., that when the code that defines such software is executed by the processor 1110, it causes the system to perform a function. In some aspects, a hardware service that performs a particular function can include the software component stored in a computer-readable medium in connection with the necessary hardware components, such as processor 1110, connection 1105, output device 1135, etc., to carry out the function. The term "computer-readable medium" includes, but is not limited to, portable or non-portable storage devices, optical storage devices, and various other mediums capable of storing, containing, or carrying instruction(s) and/or data. A computer-readable medium may include a non-transitory medium in which data can be stored and that does not include carrier waves and/or transitory electronic signals propagating wirelessly or over wired connections. Examples of a non-transitory medium may include, but are not limited to, a magnetic disk or tape, optical storage media such as CD or DVD, flash memory, memory or memory devices. A computer-readable medium may have stored thereon code and/or machine-executable instructions that may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, or the like.

In some cases, the computing device or apparatus may include various components, such as one or more input devices, one or more output devices, one or more processors, one or more microprocessors, one or more microcomputers, one or more cameras, one or more sensors, and/or other component(s) that are configured to carry out the steps of processes described herein. In some examples, the computing device may include a display, one or more network interfaces configured to communicate and/or receive the data, any combination thereof, and/or other component(s). The one or more network interfaces can be configured to communicate and/or receive wired and/or wireless data, including data according to the 3G, 4G, 5G, and/or other cellular standard, data according to the Wi-Fi (802.11x) standards, data according to the Bluetooth™ standard, data according to the IP standard, and/or other types of data.

The components of the computing device can be implemented in circuitry. For example, the components can include and/or can be implemented using electronic circuits or other electronic hardware, which can include one or more programmable electronic circuits (e.g., microprocessors, GPUs, DSPs, CPUs, and/or other suitable electronic circuits), and/or can include and/or be implemented using computer software, firmware, or any combination thereof, to perform the various operations described herein.

In some aspects, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

Numerous examples are provided herein to enhance understanding of the present disclosure. A specific set of statements are provided as follows.

Statement 1: A system comprising: a formation tester tool operable to be positioned in a wellbore, the formation tester tool operable to measure at least one property of a formation fluid within the wellbore; and at least one processor configured to: receive the at least one property of the fluid within the wellbore, a drilling pressure, a formation pressure, and at least one property of the drilling fluid; receive a drilling schedule, the drilling schedule comprising at least one change in an downhole environmental condition; and determine a radius of invasion of the drilling fluid based on the at least one property of the fluid, the drilling pressure, the formation pressure, the at least one property of the drilling fluid, and the drilling schedule.

Statement 2: The system of statement 1, wherein the at least one property of the formation fluid includes a type of fluid.

Statement 3: The system of statement 2, wherein the at least one processor is further configured to determine a flow type between the drilling fluid and the formation fluid, wherein the flow type is miscible or immiscible flow.

Statement 4: The system of statement 3, wherein determining the radius of invasion for immiscible flow is based on capillary diffusion of the drilling fluid into the formation fluid.

Statement 5: The system of statement 1, wherein the at least one change in the downhole environmental conditions includes one or more of a switch between static drilling and dynamic drilling, removal of at least a portion of the drilling fluid, and a pause in drilling.

Statement 6: The system of statement 1, wherein the at least one processor is further configured to determine a drilling fluid removal volume based on the radius of invasion.

Statement 7: The system of statement 6, wherein the drilling fluid removal volume comprises a volume of the drilling fluid to be removed to access the formation fluid, wherein the at least one pump is operable to pump the drilling fluid removal volume out of the wellbore.

Statement 8: A method comprising: providing a drilling pressure in a wellbore greater than a formation pressure of a formation, thereby causing a drilling fluid within the wellbore to invade the formation; receiving, via a formation tester tool and/or calculations, at least one property of a formation fluid within the wellbore, the drilling pressure, the formation pressure, and at least one property of the drilling fluid; receiving a drilling schedule comprising at least one change in an downhole environmental condition; determining a radius of invasion of the drilling fluid based on the at least one property of the formation fluid, the drilling pressure, the formation pressure, the at least one property of the drilling fluid, and the drilling schedule; and determining a drilling fluid removal volume based on the radius of invasion.

Statement 9: The method of statement 8, wherein the at least one property of the formation fluid includes a type of fluid.

Statement 10: The method of statement 9, further comprising determining a flow type between the drilling fluid and the formation fluid, wherein the flow type is miscible or immiscible flow.

Statement 11: The method of statement 10, wherein determining the radius of invasion for immiscible flow is based on a capillary diffusion of the drilling fluid into the formation fluid.

Statement 12: The method of statement 8, wherein the at least one change in the downhole environmental condition includes one or more of a switch between static drilling and dynamic drilling, removal of at least a portion of the drilling fluid, and a pause in drilling.

Statement 13: The method of statement 8, further comprising, removing, via the at least one pump, the drilling fluid removal volume from the wellbore.

Statement 14: The method of statement 8, wherein the drilling fluid removal volume comprises a volume of the drilling fluid to be removed to access the formation fluid.

Statement 15: A non-transitory computer readable medium, having instructions stored thereon for determining a radius of invasion of a drilling fluid, that when executed by at least one computing device cause the at least one computing device to perform operations for outputting the radius of invasion, the operations comprising: receiving at least one property of a drilling fluid pumped into a wellbore, a drilling pressure, and a formation pressure; receiving, via a formation tester tool, at least one property of a formation fluid within the wellbore; receiving a drilling schedule comprising at least one change in an downhole environmental condition; determining the radius of invasion of the drilling fluid based on the at least one property of the formation fluid, the drilling pressure, the formation pressure, the at least one property of the drilling fluid, and the drilling schedule; and determining a drilling fluid removal volume based on the radius of invasion.

Statement 16: The non-transitory computer readable medium of statement 15, wherein the at least one property of the formation fluid includes a type of the formation fluid.

Statement 17: The non-transitory computer readable medium of statement 16, wherein the operations further comprise determining a flow type between the drilling fluid and the formation fluid, wherein the flow type is miscible or immiscible flow.

Statement 18: The non-transitory computer readable medium of statement 17, wherein determining the radius of invasion for immiscible flow is based on a capillary diffusion of the drilling fluid into the formation fluid.

Statement 19: The non-transitory computer readable medium of statement 15, wherein the at least one change in the downhole environmental condition includes one or more of a switch between static drilling and dynamic drilling, removal of at least a portion of the drilling fluid, and a pause in drilling.

Statement 20: The non-transitory computer readable medium of statement 15, wherein the operations further comprise causing at least one pump to remove the drilling fluid removal volume, wherein the drilling fluid removal volume comprises a volume of the drilling fluid to be removed to access the formation fluid.

What is claimed is:

1. A system comprising:

a formation tester tool operable to be positioned in a wellbore, the formation tester tool operable to measure at least one property of a formation fluid within the wellbore; and at least one processor configured to:

receive the at least one property of the formation fluid within the wellbore, a drilling pressure, a formation pressure, and at least one property of a drilling fluid;

receive a drilling schedule, the drilling schedule comprising at least one change in a downhole environmental condition; and determine a radius of invasion of the drilling fluid based on the at least one property of the formation fluid, the drilling pressure, the formation pressure, the at least one property of the drilling fluid, and the drilling schedule.

2. The system of claim 1, wherein the at least one property of the formation fluid includes a type of fluid.

3. The system of claim 2, wherein the at least one processor is further configured to determine a flow type between the drilling fluid and the formation fluid, wherein the flow type is miscible or immiscible flow.

4. The system of claim 3, wherein determining the radius of invasion for immiscible flow is based on a capillary diffusion of the drilling fluid into the formation fluid.

5. The system of claim 1, wherein the at least one change in the downhole environmental condition includes one or more of a switch between static drilling and dynamic drilling, removal of at least a portion of the drilling fluid, and a pause in drilling.

6. The system of claim 1, wherein the at least one processor is further configured to determine a drilling fluid removal volume based on the radius of invasion.

7. The system of claim 6, wherein the drilling fluid removal volume comprises a volume of the drilling fluid to be removed to access the formation fluid, wherein at least one pump is operable to pump the drilling fluid removal volume out of the wellbore.

8. A method comprising:

providing a drilling pressure in a wellbore greater than a formation pressure of a formation, thereby causing a drilling fluid within wellbore to invade the formation;

receiving, via a formation tester tool and/or calculations, at least one property of a formation fluid within the wellbore, the drilling pressure, the formation pressure, and at least one property of the drilling fluid;

receiving a drilling schedule comprising at least one change in an downhole environmental condition;

determining a radius of invasion of the drilling fluid based on the at least one property of the formation fluid, the drilling schedule, the drilling pressure, the formation pressure, and the at least one property of the drilling fluid; and determining a drilling fluid removal volume based on the radius of invasion.

9. The method of claim 8, wherein the at least one property of the formation fluid includes a type of fluid.

10. The method of claim 9, further comprising determining a flow type between the drilling fluid and the formation fluid, wherein the flow type is miscible or immiscible flow.

11. The method of claim 10, wherein determining the radius of invasion for immiscible flow is based on a capillary diffusion of the drilling fluid into the formation fluid.

12. The method of claim 8, wherein the at least one change in the downhole environmental condition includes one or more of a switch between static drilling and dynamic drilling, removal of at least a portion of the drilling fluid, and a pause in drilling.

13. The method of claim 8, further comprising, removing, via at least one pump, the drilling fluid removal volume from the wellbore.

14. The method of claim 8, wherein the drilling fluid removal volume comprises a volume of the drilling fluid to be removed to access the formation fluid.

15. A non-transitory computer readable medium, having instructions stored thereon for determining a radius of invasion of a drilling fluid, that when executed by at least one computing device cause the at least one computing device to perform operations for outputting the radius of invasion, the operations comprising:

receiving at least one property of a drilling fluid pumped into a wellbore, a drilling pressure, and a formation pressure;

receiving, via a formation tester tool, at least one property of a formation fluid within the wellbore;

receiving a drilling schedule comprising at least one change in an downhole environmental condition;

determining the radius of invasion of the drilling fluid based on the at least one property of the formation fluid, the drilling pressure, the formation pressure, and the drilling schedule; and determining a drilling fluid removal volume based on the radius of invasion.

16. The non-transitory computer readable medium of claim 15, wherein the at least one property of the formation fluid includes a type of the formation fluid.

17. The non-transitory computer readable medium of claim 16, wherein the operations further comprise determining a flow type between the drilling fluid and the formation fluid, wherein the flow type is miscible or immiscible flow.

18. The non-transitory computer readable medium of claim 17, wherein determining the radius of invasion for immiscible flow is based on a capillary diffusion of the drilling fluid into the formation fluid.

19. The non-transitory computer readable medium of claim 15, wherein the at least one change in the downhole environmental condition includes one or more of a switch between static drilling and dynamic drilling, removal of at least a portion of the drilling fluid, and a pause in drilling.

20. The non-transitory computer readable medium of claim 15, wherein the operations further comprise causing at least one pump to remove the drilling fluid removal volume, wherein the drilling fluid removal volume comprises a volume of the drilling fluid to be removed to access the formation fluid.

* * * * *